US012415646B2

(12) United States Patent
Gilligan et al.

(10) Patent No.: US 12,415,646 B2
(45) **Date of Patent: *Sep. 16, 2025**

(54) BEVERAGE CONTAINER PACKAGING

(71) Applicant: Acorn West LLC, Los Angeles, CA (US)

(72) Inventors: John Gilligan, Santa Barbara, CA (US); Rick Gant, Napa, CA (US); David Weissberg, Century City, CA (US); Ron Valtierra, Vacaville, CA (US); Gord Heyting, Toronto (CA); Chris Russell, Brough (GB)

(73) Assignee: ACORN WEST LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/108,799

(22) Filed: Feb. 13, 2023

(65) Prior Publication Data

US 2023/0192348 A1 Jun. 22, 2023

Related U.S. Application Data

(63) Continuation of application No. 17/397,619, filed on Aug. 9, 2021, now Pat. No. 11,718,442, which is a (Continued)

(51) Int. Cl.
*B65D 1/34* (2006.01)
*B65D 1/30* (2006.01)
(Continued)

(52) U.S. Cl.
CPC ..... *B65D 1/34* (2013.01); *B65D 1/30* (2013.01); *B65D 5/5028* (2013.01); *B65D 21/04* (2013.01);
(Continued)

(58) Field of Classification Search
CPC ..... B65D 1/36; B65D 5/5028; B65D 1/34; B65D 81/133; B65D 21/04;
(Continued)

(56) References Cited

U.S. PATENT DOCUMENTS 1,310,161 A 7/1919 Johnson
1,892,170 A 12/1932 Sneed, Jr.
(Continued)

FOREIGN PATENT DOCUMENTS

BE 882835 A 8/1980
GB 2047661 A 8/1980
(Continued)

OTHER PUBLICATIONS

Complaint for Patent Infringement, dated Dec. 20, 2018, Docket No. 1 in the US District Court, Central District of California—Western Division, Case No. 2:18-cv-10568.
(Continued)

*Primary Examiner* — Rafael A Ortiz
(74) *Attorney, Agent, or Firm* — Michele V. Frank; Venable LLP

(57) ABSTRACT

A beverage container packaging assembly is disclosed. The beverage container packaging assembly includes a bottom tray, center support, and a top tray. The bottom tray includes a plurality of cup-shaped elements each configured to accommodate a bottom portion of a beverage container. Each cup-shaped element includes at least a first deformable element comprising one or more wide portions and one or more thin portions. The center support is disposed between the bottom tray and the top tray. The top tray includes bottle neck accommodating spaces each bounded by a set of vertical posts.

18 Claims, 28 Drawing Sheets

Related U.S. Application Data continuation of application No. 16/884,922, filed on May 27, 2020, now Pat. No. 11,104,471, which is a continuation of application No. 16/180,840, filed on Nov. 5, 2018, now Pat. No. 10,696,441, which is a continuation of application No. 15/671,348, filed on Aug. 8, 2017, now Pat. No. 10,124,924.

(60) Provisional application No. 62/372,129, filed on Aug. 8, 2016.

(51) Int. Cl.

| | |
|---|---|
| ***B65D 5/50*** | (2006.01) |
| ***B65D 21/04*** | (2006.01) |
| ***B65D 81/133*** | (2006.01) |
| ***D21J 3/10*** | (2006.01) |
| ***D21J 7/00*** | (2006.01) |

(52) U.S. Cl.
CPC ..... *B65D 81/133* (2013.01); *D21J 3/10* (2013.01); *D21J 7/00* (2013.01)

(58) Field of Classification Search
CPC ..... B65D 81/3813; B65D 1/30; B65D 25/10; B65D 5/50; B65D 81/02; B65D 23/0885; D21J 3/10; D21J 7/00
USPC ..... 206/433, 521.1, 521, 203, 160, 429, 206/521.3, 561, 192, 161, 1, 47, 436, 206/427; 294/87.1; 220/4.27, 4.26, 4.33, 220/920, 632, 630, 628, 62.12, 556, 528, 220/529, 5, 16, 515, 514, 513, 512, 510; 217/19
See application file for complete search history.

(56) References Cited

U.S. PATENT DOCUMENTS

| | | | | |
|---|---|---|---|---|
| 1,907,606 | A | 5/1933 | Stoddard | |
| 1,908,389 | A | 5/1933 | White | |
| 1,919,427 | A | 7/1933 | Foreman | |
| 1,960,279 | A | 5/1934 | Read | |
| 1,977,160 | A | 10/1934 | White | |
| 2,003,134 | A | 5/1935 | Bowman | |
| 2,024,648 | A | 12/1935 | Kissling | |
| 2,050,143 | A | 8/1936 | White | |
| 2,189,410 | A | 2/1940 | Stute | |
| 2,222,572 | A | 11/1940 | Reger | |
| 2,393,245 | A | 1/1946 | Hadsell | |
| 2,609,670 | A | 9/1952 | Wheeler et al. | |
| 2,807,402 | A | 9/1957 | Nelbach | |
| 2,973,119 | A | 2/1961 | Parker | |
| 2,979,227 | A | 4/1961 | Taber | |
| 3,023,885 | A | 3/1962 | Kindseth | |
| 3,038,625 | A | 6/1962 | Sinner et al. | |
| 3,039,667 | A | 6/1962 | Kozlik | |
| 3,368,709 | A | 2/1968 | Waller | |
| 3,421,679 | A | 1/1969 | Goldman | |
| 3,643,812 | A | 2/1972 | Mander et al. | |
| 3,802,220 | A | 4/1974 | Pompo | |
| 3,930,579 | A | 1/1976 | Kurtz | |
| 4,037,722 | A | 7/1977 | Bremer | |
| 4,088,259 | A * | 5/1978 | Sutton | B65D 85/324 206/521.1 |
| 4,213,310 | A | 7/1980 | Buss | |
| 4,266,407 | A | 5/1981 | Gibson | |
| 4,292,817 | A | 10/1981 | Loucks | |
| 4,344,300 | A | 8/1982 | Taylor | |
| 4,499,997 | A * | 2/1985 | Swingley, Jr. | B65D 81/261 206/427 |
| 4,554,798 | A | 11/1985 | D'Amour et al. | |
| 4,560,064 | A * | 12/1985 | Peterson | A47G 23/0266 206/427 |
| 4,580,412 | A | 4/1986 | Wells | |
| 4,607,502 | A | 8/1986 | Tomac | |
| 4,793,548 | A | 12/1988 | Ross | |
| 4,819,793 | A | 4/1989 | Willard et al. | |
| 4,911,300 | A * | 3/1990 | Colonna | B65D 71/50 206/427 |
| 4,932,548 | A | 6/1990 | Bensinger | |
| 4,947,658 | A | 8/1990 | Wheeler et al. | |
| 5,071,026 | A | 12/1991 | Apps | |
| 5,096,085 | A | 3/1992 | Eek et al. | |
| 5,201,421 | A | 4/1993 | Maier | |
| 5,215,195 | A | 6/1993 | Williams | |
| 5,335,770 | A | 8/1994 | Baker et al. | |
| 5,377,862 | A | 1/1995 | Oakes et al. | |
| 5,427,222 | A | 6/1995 | Miura et al. | |
| 5,501,352 | A | 3/1996 | Apps | |
| 5,582,343 | A | 12/1996 | Dalvey | |
| 5,816,409 | A | 10/1998 | Baker et al. | |
| 5,913,444 | A | 6/1999 | Steiner | |
| 5,950,829 | A | 9/1999 | Gale | |
| 5,975,300 | A | 11/1999 | Gale | |
| 6,290,057 | B1 | 9/2001 | Hurley | |
| 6,325,210 | B1 * | 12/2001 | Henry, Jr. | B65D 5/503 206/427 |
| 6,334,329 | B1 | 1/2002 | Weller | |
| 6,336,556 | B1 | 1/2002 | Gale | |
| 6,598,419 | B1 | 7/2003 | Tago | |
| 6,702,115 | B1 | 3/2004 | Roper | |
| 6,820,743 | B2 | 11/2004 | Hurley et al. | |
| 6,910,582 | B2 | 6/2005 | Lantz | |
| 7,017,746 | B2 | 3/2006 | Apps | |
| D561,025 | S | 2/2008 | Gilfert | |
| D561,588 | S | 2/2008 | Gilfert | |
| D590,715 | S | 4/2009 | Gilfert | |
| 7,584,852 | B2 | 9/2009 | O'Brien et al. | |
| 7,743,626 | B2 | 6/2010 | Buckingham | |
| 7,789,239 | B2 * | 9/2010 | Juliano | B65D 5/503 206/592 |
| D631,352 | S | 1/2011 | Gilfert | |
| D632,960 | S | 2/2011 | Gilfert | |
| 7,883,001 | B2 | 2/2011 | Goodrich | |
| 8,333,275 | B2 * | 12/2012 | McFarlane | B65D 1/243 220/519 |
| 8,434,620 | B2 | 5/2013 | Hall | |
| 8,607,984 | B2 * | 12/2013 | Breton | B65D 1/36 206/427 |
| 8,701,884 | B2 | 4/2014 | Williams et al. | |
| 8,844,718 | B2 | 9/2014 | Hall | |
| 8,887,916 | B2 | 11/2014 | Gilfert et al. | |
| 10,059,495 | B1 | 8/2018 | Korustan et al. | |
| 10,124,924 | B2 | 11/2018 | Gilligan et al. | |
| 10,281,188 | B2 | 5/2019 | Shew | |
| 10,507,950 | B2 | 12/2019 | Carrier et al. | |
| 10,619,905 | B2 | 4/2020 | Starling | |
| 10,696,441 | B2 | 6/2020 | Gilligan et al. | |
| 11,104,471 | B2 | 8/2021 | Gilligan et al. | |
| 11,261,015 | B2 | 3/2022 | Gilligan et al. | |
| 11,377,290 | B2 | 7/2022 | Morine | |
| 11,685,570 | B2 | 6/2023 | Gilligan et al. | |
| 11,713,173 | B2 | 8/2023 | Gilligan et al. | |
| 11,718,442 | B2 | 8/2023 | Gilligan et al. | |
| 12,104,847 | B1 | 10/2024 | Hurley | |
| 2003/0070951 | A1 | 4/2003 | Hurley et al. | |
| 2004/0031711 | A1 | 2/2004 | O'Malley | |
| 2007/0138047 | A1 | 6/2007 | Berglin | |
| 2007/0277546 | A1 | 12/2007 | Lehman | |
| 2008/0184674 | A1 | 8/2008 | Hall et al. | |
| 2008/0302691 | A1 | 12/2008 | Olson et al. | |
| 2010/0112292 | A1 | 5/2010 | Gilfert | |
| 2010/0326858 | A1 * | 12/2010 | Williams | B65D 85/305 206/429 |
| 2011/0024318 | A1 | 2/2011 | Gilfert | |
| 2011/0030418 | A1 | 2/2011 | Starling | |
| 2012/0037529 | A1 | 2/2012 | Hall | |
| 2013/0068829 | A1 | 3/2013 | Dillon et al. | |
| 2013/0126384 | A1 | 5/2013 | Ogg | |
| 2013/0213854 | A1 | 8/2013 | Orgeldinger et al. | |
| 2013/0313145 | A1 * | 11/2013 | Gilfert | B65D 81/113 53/472 |
| 2014/0319018 | A1 | 10/2014 | Collison | |

(56) References Cited

U.S. PATENT DOCUMENTS

| | | | | |
|---|---|---|---|---|
| 2015/0129447 | A1* | 5/2015 | Tremblay | B65D 81/058 206/521 |
| 2015/0210457 | A1 | 7/2015 | DiMauro | |
| 2016/0290703 | A1 | 10/2016 | Allen | |
| 2017/0050757 | A1* | 2/2017 | Gray | B65D 81/133 |
| 2017/0138664 | A1 | 5/2017 | Greenberg | |
| 2018/0037359 | A1 | 2/2018 | Gilligan et al. | |
| 2019/0100347 | A1 | 4/2019 | Carrier et al. | |
| 2019/0178571 | A1 | 6/2019 | Kelly | |
| 2020/0109888 | A1 | 4/2020 | Gosselin | |
| 2021/0018244 | A1 | 1/2021 | Díaz | |
| 2021/0139215 | A1 | 5/2021 | Gilligan et al. | |
| 2021/0354870 | A1 | 11/2021 | Gilligan et al. | |
| 2022/0127057 | A1 | 4/2022 | Ronning et al. | |
| 2023/0159255 | A1 | 5/2023 | Gilligan et al. | |
| 2023/0271742 | A1 | 8/2023 | Gilligan et al. | |

FOREIGN PATENT DOCUMENTS

| | | | |
|---|---|---|---|
| GB | 2328934 | A | 3/1999 |
| WO | 2008058346 | A1 | 5/2008 |
| WO | 2011073406 | A1 | 6/2011 |
| WO | 2015/049702 | A1 | 4/2015 |

OTHER PUBLICATIONS

Defendant's Answer to Complaint; Counterclaims; and Demand for Jury Trial, dated Jun. 7, 2019 , Docket No. 22 in the US District Court, Central District of California—Western Division, Case No. 2:18-cv-10568-CJC-SK.

Answer and Affirmative Defenses to Defendants; and Counterclaims and Demand for Jury Trial, dated Jun. 28, 2019 Docket No. 27 in the US District Court, Central District of California—Western Division, Case No. 2:18-cv-10568-CJC- SK.

Complaint for Patent Infringement, dated Jan. 15, 2021, U.S. District Court Eastern District of Washington, Case No. 2:21-cv-00036-1 with Exhibits A (U.S. Pat. No. 10,124,924) and B (U.S. Pat. No. 10,696,441) (97 pages).

Notice of Allowance and Fees Due dated Jul. 31, 2018, directed to U.S. Appl. No. 15/671,348; 13 pages.

Non-Final Office Action dated May 28, 2019, directed to U.S. Appl. No. 16/180,840; 19 pages.

Final Office Action dated Sep. 12, 2019, directed to U.S. Appl. No. 16/180,840; 21 pages.

Notice of Allowance and Fees Due dated Jan. 15, 2020, directed to U.S. Appl. No. 16/180,840; 8 pages.

Notice of Allowance and Fees Due dated Mar. 18, 2020, directed to U.S. Appl. No. 16/180,840; 8 pages.

Non-Final Office Action dated Aug. 26, 2020, directed to U.S. Appl. No. 16/884,922; 16 pages.

Non-Final Office Action dated Mar. 15, 2021, directed to U.S. Appl. No. 17/098,190; 15 pages.

Notice of Allowance dated Apr. 28, 2021, directed to U.S. Appl. No. 16/884,922; 7 pages.

Non-Final Office Action dated Aug. 11, 2021, directed to U.S. Appl. No. 17/321,195; 14 pages.

Complaint for Patent Infringement and Breach of Contract; Jury Trial Demanded, dated Sep. 30, 2021, United States District Court for the Central District of California; Case No. 2:21-cv-7821; 20 pages.

Defendants' Joint Answer, Affirmative Defenses, and Counterclaims to Plaintiff's Complaint; Demand for a Jury Trial dated Dec. 28, 2021; United States District Court for the Central District of California; Case No. 2:21-cv-07821-CJC-SK; 29 pages.

First Amended Complaint for Patent Infringement and Breach of Contract, Jury Trial Demanded dated Jan. 18, 2022; United States District Court for the Central District of California; Case No. 2:21-cv-07821-CJC-SK; 20 pages.

Defendants' Joint Answer, Affirmative Defenses, and Counterclaims to Plaintiff's First Amended Complaint for Patent Infringement and Breach of Contract; Demand for a Jury Trial dated Feb. 1, 2022; United States District Court for the Central District of California; Case No. 2:21-cv-07821-CJC-SK; 43 pages.

Plaintiff Acorn West LLC's Answer to Counterclaims and Affirmative Defenses; Jury Trial Demanded, dated Feb. 22, 2022; United States District Court for the Central District of California; Case No. 2:21-cv-07821-CJC-SK; 14 pages.

Notice of Allowance and Fee(s) Due dated Mar. 15, 2022, directed to U.S. Appl. No. 17/397,619; 7 pages.

Notice of Allowance and Fee(s) Due dated Mar. 31, 2022, directed to U.S. Appl. No. 17/321,195; 9 pages.

Notice of Allowance and Fee(s) Due dated Jun. 14, 2022, directed to U.S. Appl. No. 17/397,619; 5 pages.

Corrected Notice of Allowability dated Jun. 23, 2022, directed to U.S. Appl. No. 17/397,619; 2 pages.

Notice of Allowance and Fee(s) Due dated Jul. 6, 2022, directed to U.S. Appl. No. 17/321,195; 8 pages.

Notice of Motion to Amend First Amended Complaint; Memorandum of Points and Authorities in Support Thereof filed Sep. 7, 2022, United States District Court For The Central District Of California, Case No. 2:21-cv-07821-CJC-SK; 10 pages.

Declaration of Sarah S. Brooks in Support of Plaintiff's Notice of Motion to Amend First Amended Complaint and Memorandum of Points and Authorities in Support Thereof filed Sep. 7, 2022, United States District Court For The Central District Of California; 114 pages.

Defendants' Joint Answer, Affirmative Defenses, And Counterclaims To Plaintiff's Second Amended Complaint For Patent Infringement And Breach Of Contract dated Oct. 12, 2022; 67 pages.

Notice of Allowance and Fee(s) Due dated Feb. 16, 2023, directed to U.S. Appl. No. 17/321,195; 8 pages.

Notice of Allowance and Fee(s) Due dated Jun. 23, 2021, directed to U.S. Appl. No. 17/098,190; 10 pages.

Notice of Allowance and Fee(s) Due dated Oct. 8, 2021, directed to U.S. Appl. No. 17/098,190; 10 pages.

Non-Final Rejection dated Apr. 4, 2022, directed to U.S. Appl. No. 17/581,431; 12 pages.

Notice of Allowance and Fee(s) Due dated Aug. 3, 2022, directed to U.S. Appl. No. 17/581,431; 7 pages.

Corrected Notice of Allowability dated Aug. 30, 2022, directed to U.S. Appl. No. 17/581,431; 4 pages.

Notice of Allowance and Fee(s) Due dated Mar. 16, 2023, directed to U.S. Appl. No. 17/581,431; 8 pages.

Non-Final Rejection dated Mar. 21, 2024, directed to U.S. Appl. No. 18/143,697; 7 pages.

Non-Final Rejection dated Oct. 18, 2024, directed to U.S. Appl. No. 17/993,818; 10 pages.

Non-Final Rejection dated Oct. 22, 2024, directed to U.S. Appl. No. 17/993,822; 10 pages.

Final Rejection dated Nov. 14, 2024, directed to U.S. Appl. No. 18/143,697; 8 pages.

Notice of Allowance dated Jan. 29, 2025, directed to U.S. Appl. No. 18/143,697; 8 pages.

Final Rejection dated Feb. 27, 2025, directed to U.S. Appl. No. 17/993,818; 12 pages.

Final Rejection dated May 23, 2025, directed to U.S. Appl. No. 17/993,822; 16 pages.

Notice of Allowance dated Jun. 2, 2025, directed to U.S. Appl. No. 18/143,697; 7 pages.

* cited by examiner

BEVERAGE CONTAINER PACKAGING

CROSS REFERENCE TO RELATED APPLICATION

This application is a continuation application of U.S. patent application Ser. No. 17/397,619, filed Aug. 9, 2021, which is a continuation of U.S. patent application Ser. No. 16/884,922, filed on May 27, 2020, which issued as U.S. Pat. No. 11,104,471 on Aug. 11, 2021, which is a continuation of U.S. patent application Ser. No. 16/180,840, filed Nov. 5, 2018, and which issued as U.S. Pat. No. 10,696,441 on Jun. 30, 2020, which is a continuation of U.S. patent application Ser. No. 15/671,348 filed Aug. 8, 2017, which issued as U.S. Pat. No. 10,124,924 on Nov. 13, 2018, which claims priority to U.S. Provisional Application No. 62/372,129, filed on Aug. 8, 2016, the entire contents of the disclosures of which are hereby incorporated by reference in their entireties.

TECHNICAL FIELD

The present invention relates to packaging materials, and particularly to packaging for beverage containers, such as wine bottles, beer bottles, spirits bottles, and the like.

BACKGROUND

Historically, packaging materials for shipment of beverage containers (e.g., wine bottles, beer bottles, spirits bottles, etc.) have included bubble wrap, Styrofoam, popcorn, and other traditional packaging materials. For example, multiple bottles could be wrapped in bubble wrap, positioned in Styrofoam, and/or otherwise secured and placed into a box for transit. More recently, molded paper pulp trays have been used to secure multiple bottles during transit. Typically, a bottom tray accommodates the bottom of a bottle, a top tray accommodates the top of the bottle, and cardboard may be installed between the bottles. Many existing bottom tray designs include ring-shaped crushable elements to absorb impact during shipping. The ring-shaped crushable elements may be ineffective in reducing and/or preventing damage to the bottle when the package is subjected to a large impact and/or multiple large impacts. An improved beverage container packaging would be useful.

BRIEF DESCRIPTION OF DRAWINGS

The foregoing and other features and advantages of the invention will be apparent from the following, more particular description of various exemplary embodiments, as illustrated in the accompanying drawings wherein like reference numbers generally indicate identical, functionally similar, and/or structurally similar elements. The first digits in the reference number indicate the drawing in which an element first appears.

DETAILED DESCRIPTION

Figure 1:
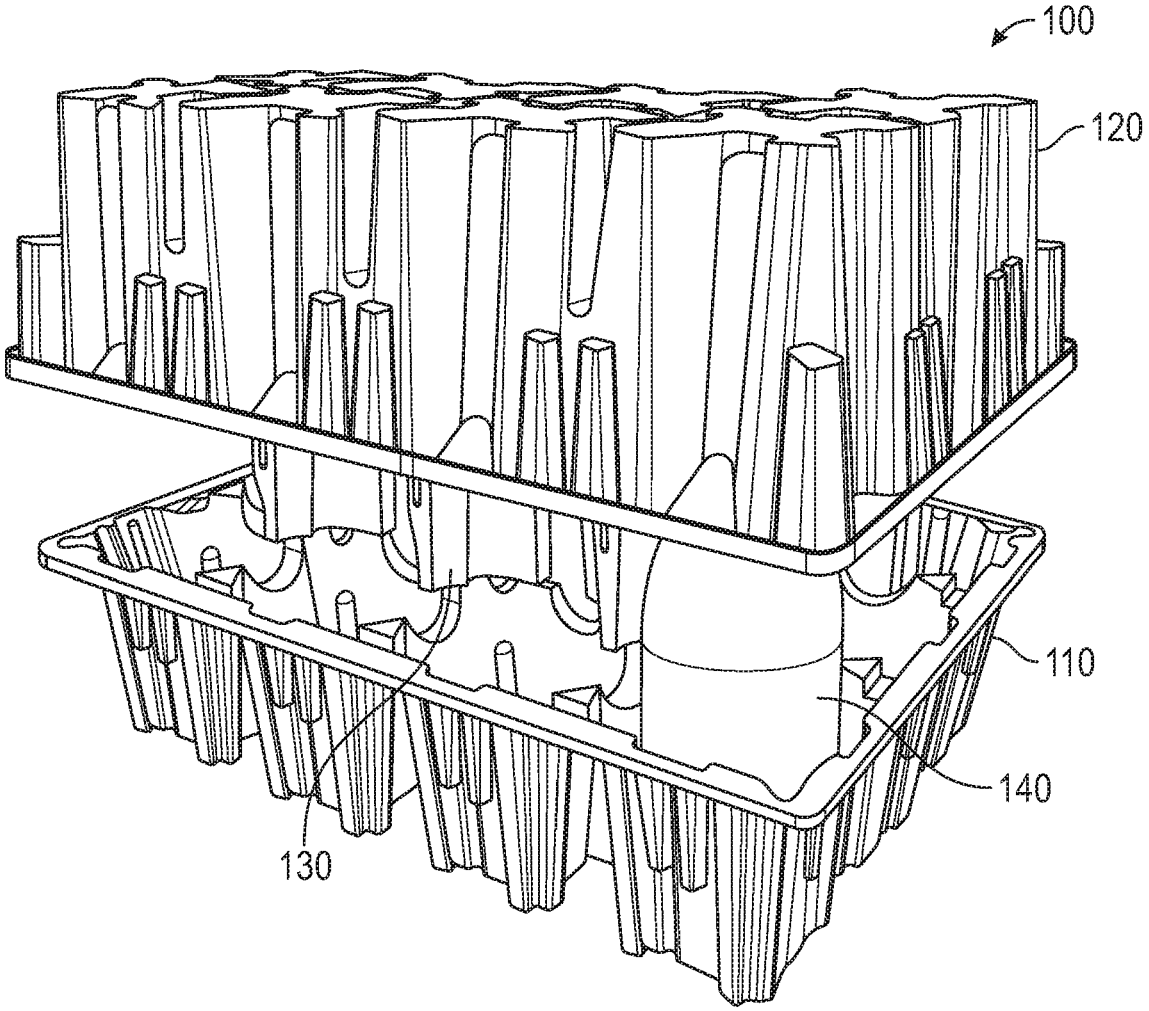
FIG. 1 depicts a beverage container packaging assembly according to various embodiments.

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without parting from the spirit and scope of the embodiments. It is to be understood that each specific element includes all technical equivalents that operate in a similar manner to accomplish a similar purpose. The examples and embodiments described herein are non-limiting examples.

All publications and references cited herein are hereby incorporated by reference in their entirety.

As used herein, the term "a" refers to one or more. The terms "including," "for example," "such as," "e.g.," "may be" and the like, are meant to include, but are not be limited to, the listed examples.

Beverage container packaging is disclosed. The beverage container packaging disclosed herein in various embodiments may include a bottom element (bottom tray, bottom insert), a top element (top tray, top insert), and/or a center support (e.g., center support element). These elements may retain multiple beverage containers, such as wine bottles, beer bottles, spirits bottles, and the like, for shipment in a container, such as a cardboard box, crate, or other container. The beverage containers may vary in size including, for example, 375 ml, 500 ml, 750 ml, or any other size. The term beverage container as used herein may also refer to any container that encloses a fluid, whether or not the fluid is a beverage. Beverage containers may be placed bottom down in the bottom tray. The center support rests on top of the bottom tray and separates the multiple bottles. The center support separates the bottom tray and top tray, thereby providing stacking support. The top tray rests on the center support. And the top element accommodates the top (neck) of the beverage containers. The bottom tray, center support, top tray, and beverage containers are placed in a container, such as a cardboard box, crate, etc., for transit.

In various embodiments, the bottom tray comprises molded paper pulp fabricated from, for example, recycled paper products. The bottom tray may include multiple cup-shaped elements (e.g., cup-shaped cavities) each contoured to encapsulate the bottom of a beverage container, such as a wine bottle, beer bottle, spirits bottles, or the like. In certain cases, the cylindrical cup-shaped element includes an hourglass-shaped deformable element and/or a cross shaped deformable element protruding from the bottom surface of the cup, deformable protrusions on the walls of the cup, and/or other features. These features retain the base of the beverage container in a stationary position during shipment by contacting the base of the container in multiple locations. These features of the cup-shaped element, particularly the hourglass shaped and/or cross-shaped deformable element absorb energy when the container is subjected to impact forces (e.g., when dropped, roughly handled, etc.).

In some embodiments, the top tray comprises molded paper pulp. In certain cases, the top tray may include multiple rectangular cup-shaped elements each contoured to encapsulate the top of a beverage container, such as the neck of a wine bottle, beer bottle, spirits bottle, or other container. The rectangular cup-shaped element may include a cylindrical depression, vertical protrusions on the walls of the cup, and/or other features. These features retain the neck and/or upper portion of the beverage container in a stationary position during shipment by contacting the neck of the container in multiple locations.

In various embodiments, the center support may comprise one or more sheets of cardboard, such as corrugated cardboard. In some cases, the center support may comprise molded paper pulp that is molded to encapsulate beverage containers.

The beverage container packaging assembly disclosed herein in various embodiments provides improved impact energy absorption characteristics in relation to existing packaging solutions. The beverage container packaging disclosed herein may also be cheaper to produce than existing packaging solutions.

FIG. 1 depicts a beverage container packaging assembly according to various embodiments. In the example shown, a beverage container packaging assembly 100 may include a bottom tray 110 (e.g., bottom element), a top tray 120 (e.g., a top element), a center support 130 (e.g., center support element, partition element), and/or other components. The beverage container packaging assembly 100 is configured to package a plurality of beverage containers 140 for transit. In the example shown, the beverage container packaging assembly 100 is configured to package 12 bottles. The base of the beverage container 140 sits in a cylindrical cup-shaped elements of the bottom tray 110. The center support 130 separates the bottom tray 110 and top tray 120. The top tray 120 rests on the center support 130. The top of the beverage container 140 is encapsulated in a bottle accommodating space of the top tray 120. The center support 130 prevents the sides of the beverage containers 140 from contacting during shipping and provides spacing between the bottom tray 110 and top tray 120. In certain cases, the center support 130 may not be included in the beverage container packaging assembly 100.

Figure 2:
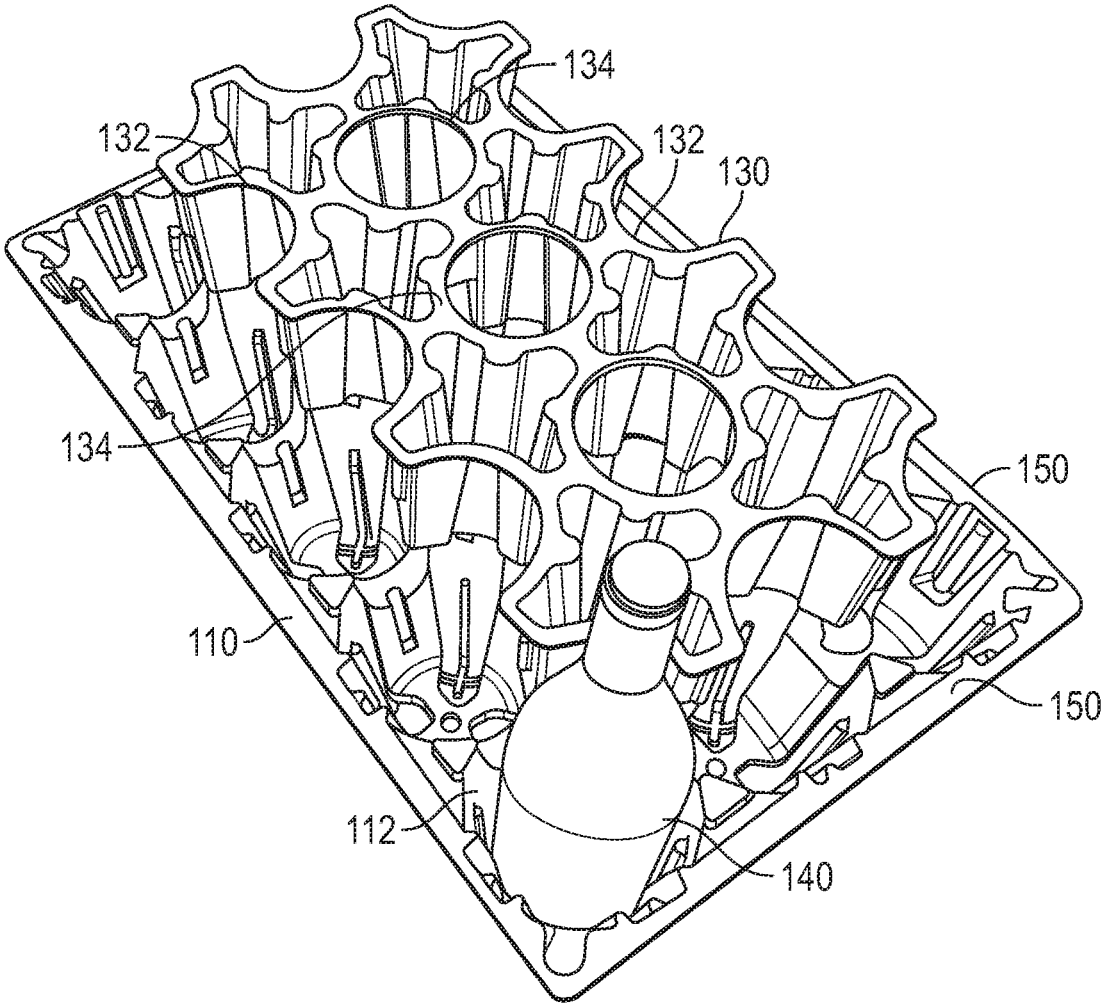
FIG. 2 depicts a bottom tray and center support of a beverage container packaging assembly according to various embodiments.

FIG. 2 depicts a bottom tray and center support of a beverage container packaging assembly according to various embodiments. In the example shown, a beverage container 140 (e.g., wine bottle) is seated in a cup-shaped element 112 of a bottom tray 110. The cup-shaped element 112 is shaped to retain the beverage container 140 in a vertical configuration during transit. In the example shown, a center support 130 is fabricated from molded paper pulp and/or similar materials. The center support 130 includes exterior support cavities 132, interior support cavities 134, and/or other elements.

In some embodiments, the center support 130 does not extend to an outer edge 150 of the bottom tray 110 and/or an outer edge of the bottle container packaging assembly (e.g., bottle container packaging assembly 100 of FIG. 1). In this case, the center support 130 is located on an interior portion of the beverage container packaging assembly and does not contact the box. A center support 130 that does not next extend to an outer edge 150 of the bottom tray 110 may require less material than other large center support designs.

As discussed below, other types of center supports, such as corrugated cardboard center supports, may be used. In certain cases, a type of center support may be selected based on shipping requirements, load absorption parameters, customer preferences, and/or any other parameters.

Figure 3:
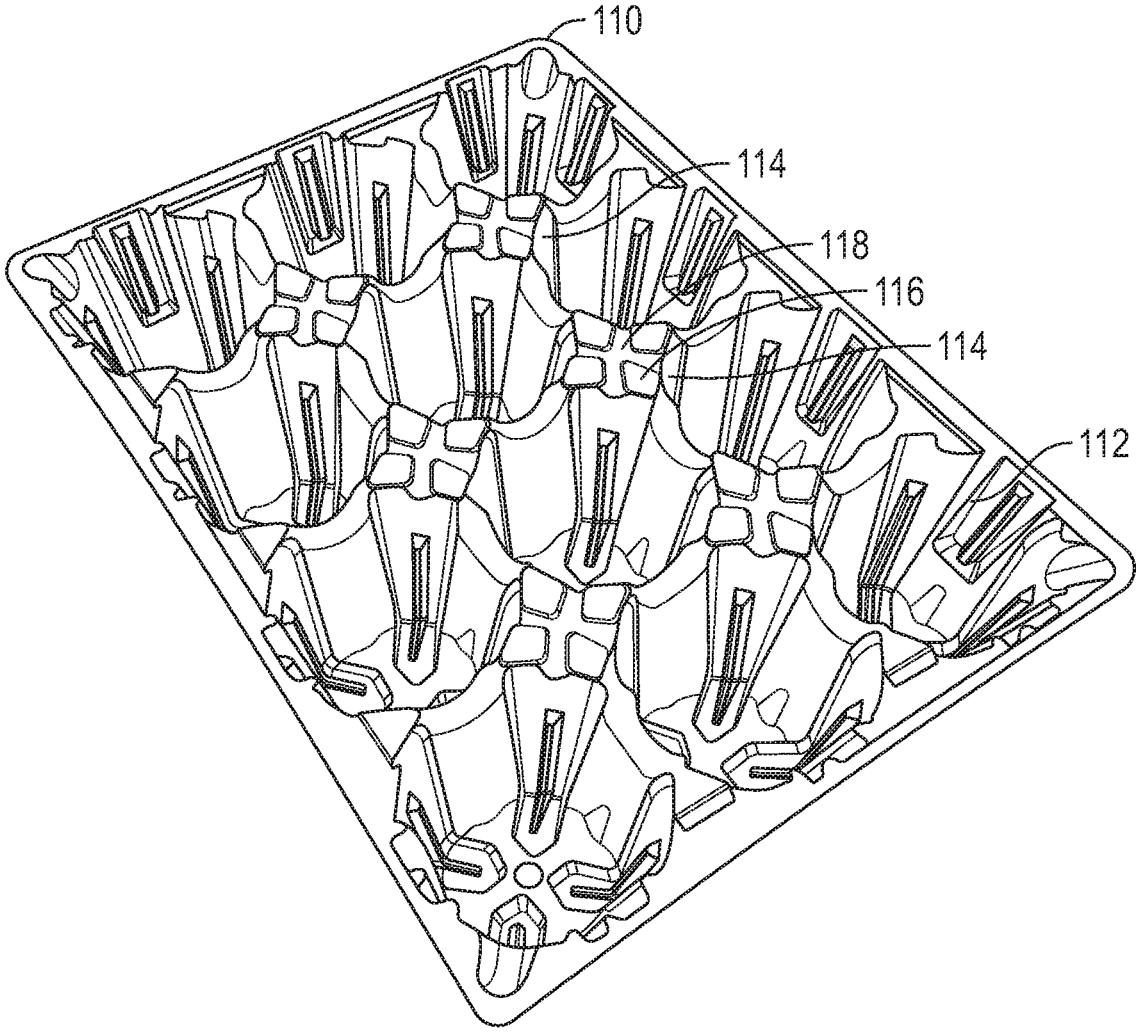
FIG. 3 depicts a bottom tray of a beverage container packaging assembly according to some embodiments.

FIG. 3 depicts a bottom tray of a beverage container packaging assembly according to some embodiments. As shown, a bottom tray 110 includes a plurality of cup-shaped elements 112. The number of cup-shaped elements 112 corresponds to a number of beverage containers the bottom tray 110 is configured to accommodate. In the example shown, the bottom tray 110 includes twelve cup-shaped elements 112—three (3) rows of four (4) cup-shaped elements 112. The bottom tray 110 is thus configured to accommodate 12 beverage containers. FIG. 3 depicts one example configuration of cup-shaped elements. The present disclosure, however, is in no way limited to the depicted configuration or number of cup-shaped elements 112.

In certain cases, the bottom tray 110 includes posts 114 configured to support the center support (not shown). Each of the posts 114 (six in the example shown) may include a plurality of platforms 116 (e.g., deformable post elements, protrusions, etc.) that form flat surfaces to contact the center support. The platforms 116 may be arranged in sets to resemble a cross shape. The platforms 116 may also be deformable and/or flexible to absorb load applied to the bottom tray 110, thereby reducing any load applied to the beverage containers 140.

Figure 4:
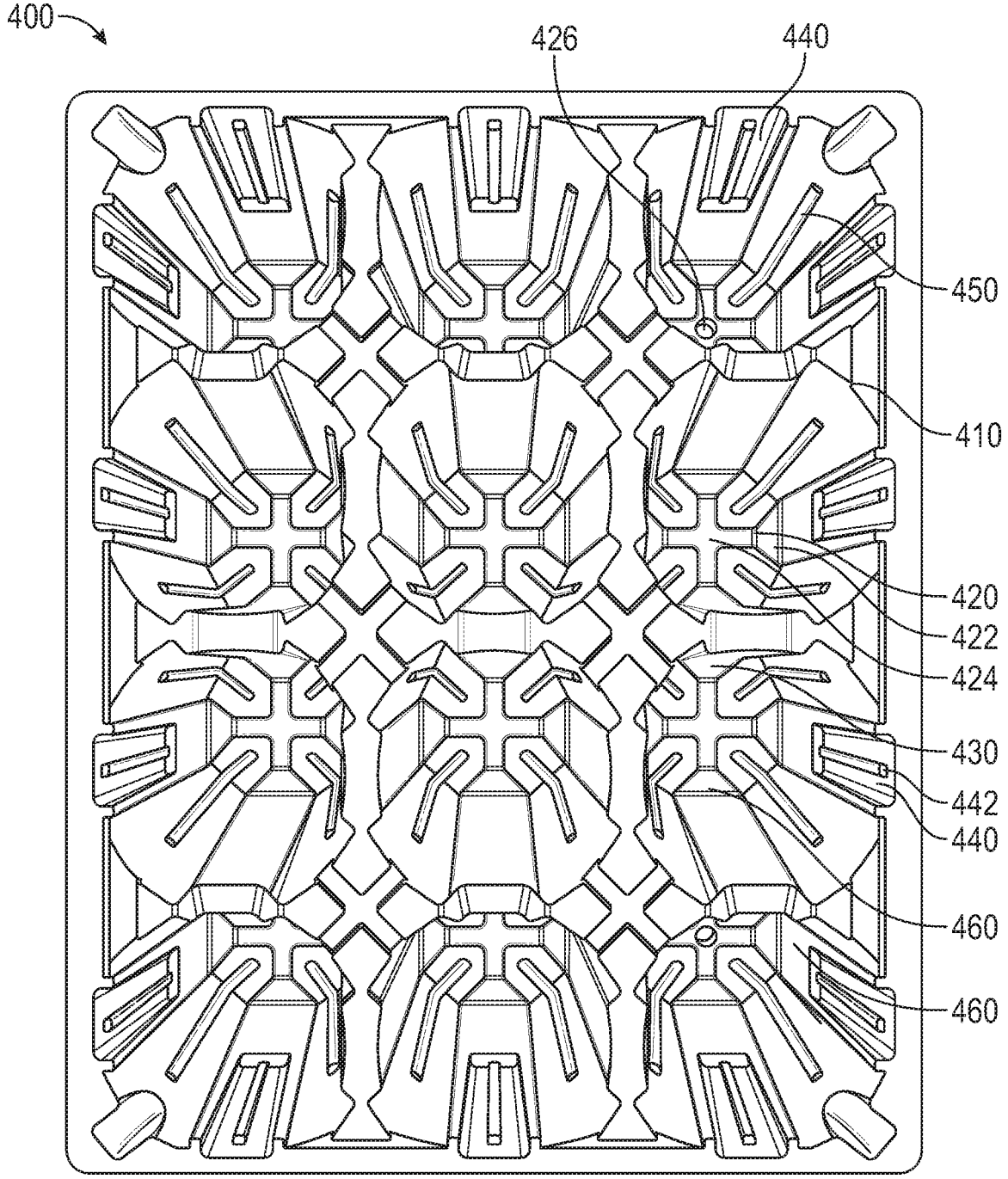
FIG. 4 depicts a first view of a bottom tray according to various embodiments.

FIG. 4 depicts a first view of a bottom tray according to various embodiments. In the example shown, a bottom tray 400 includes a plurality of cup-shaped elements 410 (e.g., cup shaped element 112 of FIGS. 1-3). In certain cases, each of the cup-shaped elements 410 is cylindrical and/or substantially cylindrical. The cup-shaped element 410 may include a bottom portion and multiple side walls forming a cup shape. In certain cases, the side walls may not be vertical but may include draft, such a seven degree draft, to enable the bottom tray 400 to be easily removed from a mold during fabrication.

Each of multiple cup-shaped elements 410 may include one or more of deformable elements 420 on the base (bottom) of the cup-shaped elements 410, first deformable elements 430 on the cup-shaped elements 410, second deformable elements 440 on side(s) of the cup-shaped elements 410, thin deformable elements 450 on sides of the cup-shaped elements 410, and/or other components.

The deformable elements 420 (e.g., base deformable elements) on the base (bottom) of the cup-shaped elements 410 may be raised (e.g., protrusions) from the bottom surface of the cup-shaped element 410. The deformable elements 420 on the bottom of the cup-shaped element 410 may resemble a cross, overlapping bowties, and/or other similar shapes. The deformable elements 420 are configured to absorb impact with the bottom of a beverage container, such as a load applied to a top or bottom of a beverage container when boxes are stacked, a box is dropped, and/or otherwise handled. The cross-shaped deformable element 420 may be particularly effective in absorbing impact on a bottle with a convex bottom shape, such as certain wine bottles. In certain cases, wider portions 422 of the cross-shaped deformable element 420 are configured to contact the outer edges of the bottom of a beverage container, such as a wine bottle. Thinner portions 424 of the cross-shaped deformable element 420 allow the element to deform (for example, by bending, crumpling, and/or otherwise deforming) when a load is applied to a beverage container housed in the bottom tray 400. The cross-shaped deformable element 420 deforms to absorb load and reduce damage to a bottle, particularly when a load is applied down from the top on the bottle or when the assembly is dropped.

In some embodiments, deformable elements 420 on a bottom of the cup-shaped elements 410 include holes 426. The holes 426 may vent air as the bottom tray 400 is lowered into a box (not shown). Vent holes 426 may reduce the vacuum in the box as the bottom tray 400 is installed in a box, thereby making assembly easier.

In various embodiments, the cup-shaped element 410 includes multiple vertical deformable elements 430, 440. The vertical deformable elements 430, 440 are configured to contact the sides of a beverage container (not shown). In certain cases, first vertical elements 430 and second vertical elements 440 are configured to contact the outside of a bottle. The vertical deformable elements 430, 440 may be sized, such that a bottle contacts at least a portion of each of the vertical deformable elements 430, 440 when loaded into the cup-shaped element 410. The bottle (not shown) and vertical deformable elements 430, 440 may contact one another in an interference fit, such that a force is necessary to push the bottle into the cup-shaped element 410 and a force is necessary to remove the bottle from the cup-shaped element 410. Securing the bottle in the cup-shaped element 410 in such a manner ensures that the bottle is stationary during transit, thereby reducing any potential damage. In certain cases, the vertical deformable elements 430, 440 can include a protrusions 460 near the bottom of the cup-shaped element 410 extending toward a center of the cup-shaped element 410. The protrusions 460 may increase the interference fit between the cup-shaped element 410 and a bottle.

In certain cases, a first type of vertical deformable elements 430 are included on the walls between adjacent cup-shaped elements 410. The first vertical elements 430 include a contoured protrusion configured to contact the outside of a bottle.

In some embodiments, a second type of vertical deformable elements 440 are included on outer walls of the cups-shaped element 410 (e.g., walls of the cup-shaped elements not adjacent to any other cup-shaped element 410). A lower portion of the second vertical deformable elements 440 may resemble the structure of the first vertical deformable elements 430, and an upper portion may include multiple thinner protrusions 442. In the example shown, the multiple thin protrusions 442 may resemble a fork.

According to some embodiments, the cup-shaped element 410 includes multiple thin deformable elements 450. In certain cases, thin deformable elements 450 may extend from a center of the cup-shaped element up a side of the cup-shaped element 410. Thin deformable elements 450 may include thin protrusions spaced roughly 90 degrees apart from one another. In certain cases, the thin deformable elements 450 may be spaced roughly 45 degrees from the intersection of the cross-shaped deformable element 420. In the example shown, there are four thin deformable elements 450 in each cup shaped element 410. Though in other cases, a cup-shaped element 410 may include other numbers of first thin deformable elements 450.

Figure 5:
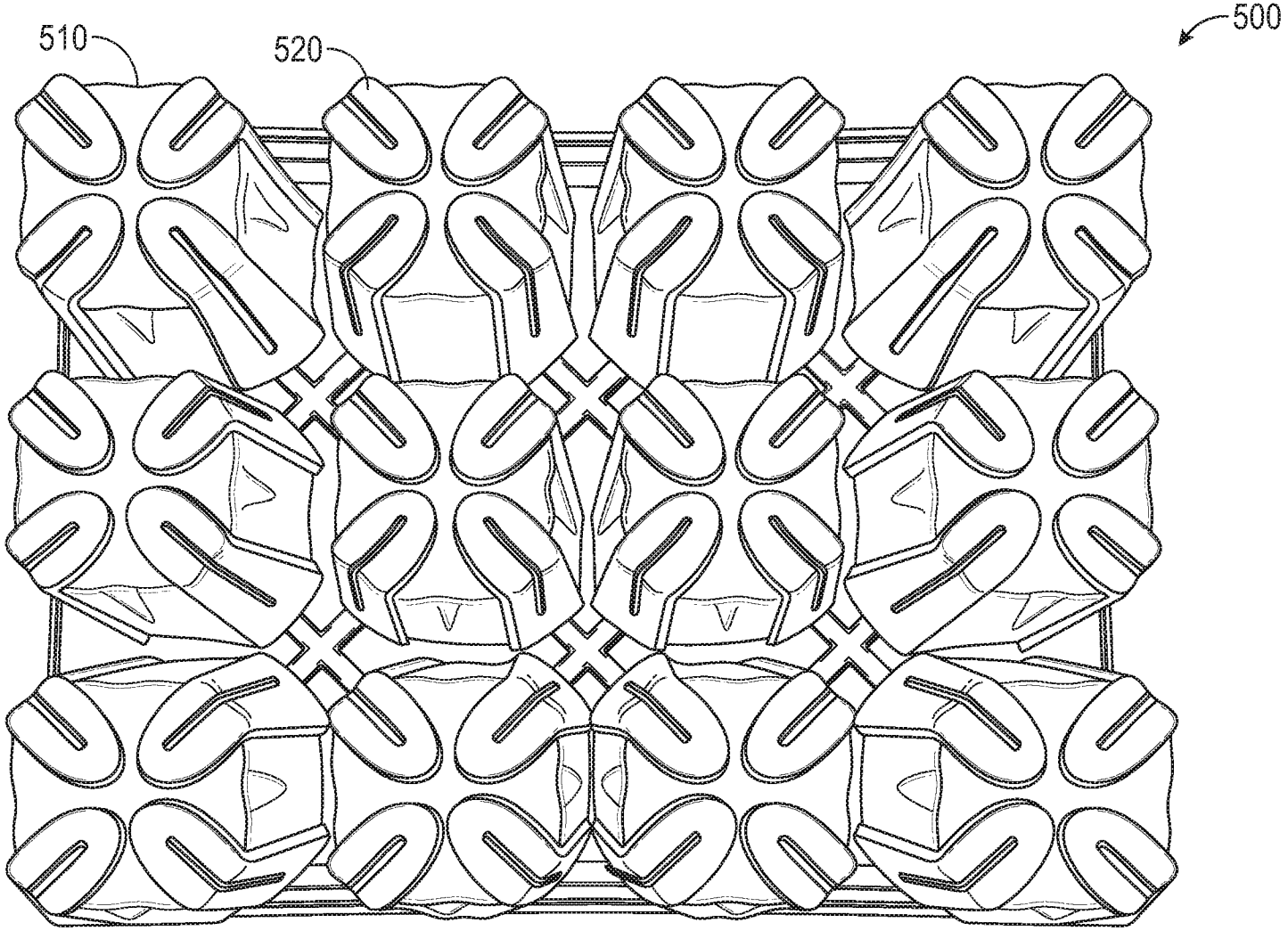
FIG. 5 depicts a second view of a bottom tray according to various embodiments.

FIG. 5 depicts a second view of a bottom tray according to various embodiments. In the example shown, which may include an opposite side of the bottom tray from FIG. 4, a bottom tray 500 includes multiple cup-shaped elements 510. The bottom side of the bottom tray 500 includes non-contoured pulp paper. The bottom side of the cup-shaped elements 510 may include protrusions 520 (e.g., four protrusions in the example shown) extending from the bottom of the cup-shaped element 510 up each side. The protrusions 520 may absorb impact and reduce loads applied to the beverage containers during, for example, an impact event.

Figure 6:
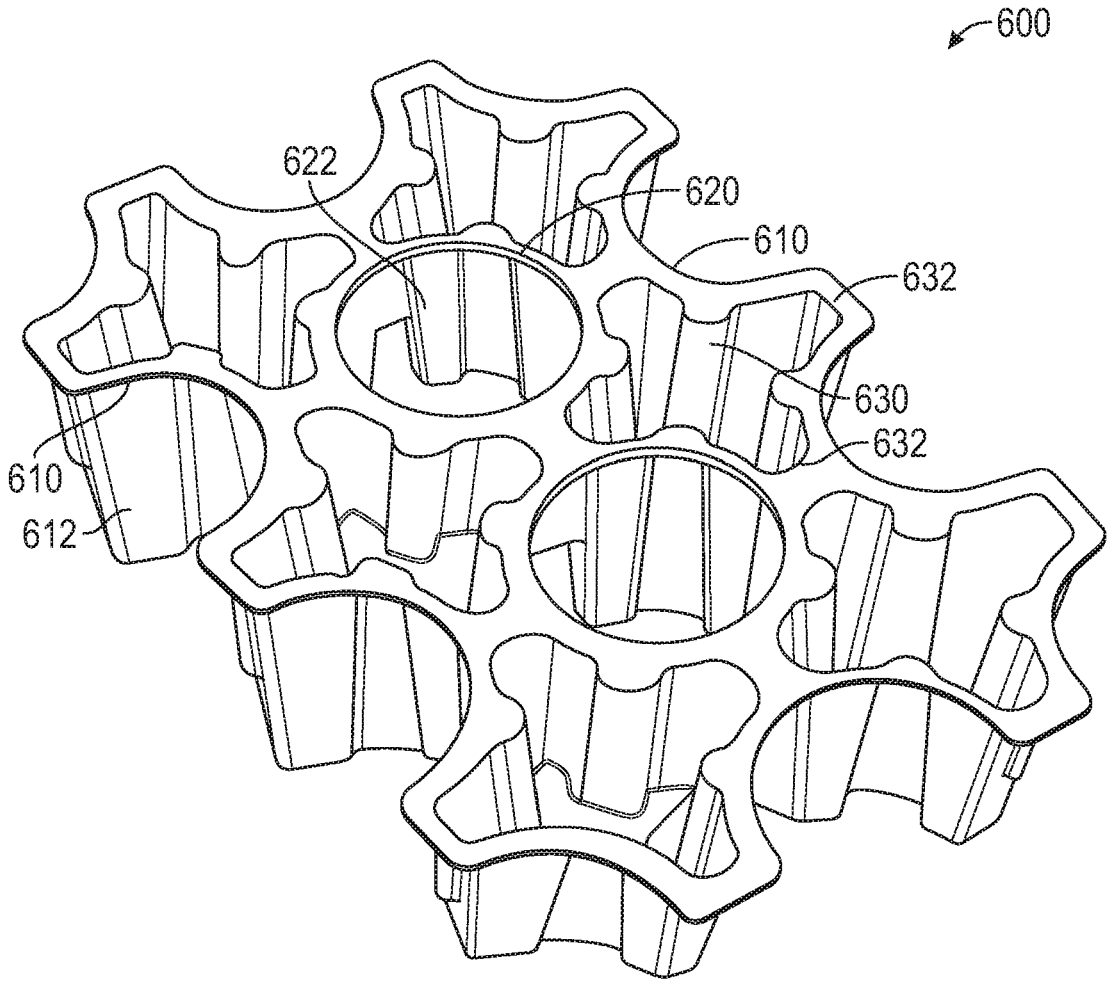
FIG. 6 depicts a center support of a beverage container packaging assembly according to various embodiments.

FIG. 6 depicts a center support of a beverage container packaging assembly according to various embodiments. In the example shown, a center support 600 includes a plurality of exterior support cavities 610 (e.g., beverage container support cavities), interior support cavities 620, and/or other elements. The exterior support cavities 610 and interior support cavities 620 maintain the bottle upright and to separate each bottle from adjacent bottles. Exterior support cavities 610 may include a semi-circular shape that follows the contour of a wine bottle. An exterior support cavity 610 encapsulates a portion of a beverage container (e.g., a body, shoulder, or neck of a bottle). In certain cases, an exterior support cavity 610 includes walls 612 including a draft angle of seven degrees and/or another draft angle. The interior support cavities 620 may include a circular (cylindrical) enclosure. The interior support cavities 620 may fully encapsulate (surround) a neck, shoulder, body and/or other component of a beverage container. Walls 622 of the interior support cavities 620 may include a draft angle of seven degrees and/or another draft angle.

In some embodiments, the center support 600 includes star shaped cavities 630 (e.g., cross shaped cavities). The star-shaped cavities 630 may form the borders of the exterior support cavities 610, interior support cavities 620, and/or other elements. In certain cases, the posts of a top tray (discussed below) contact the corners 632 of the star-shaped cavities 630 when assembled. In certain cases, the corners 632 of the star-shaped cavities 630 extend out away from the center far enough to provide cushion between adjacent beverage containers. For example, the corners 632 of the star-shaped cavities 630 can extend out away from the center far enough to encapsulate at least half of the circumference of a bottle.

Figure 7:
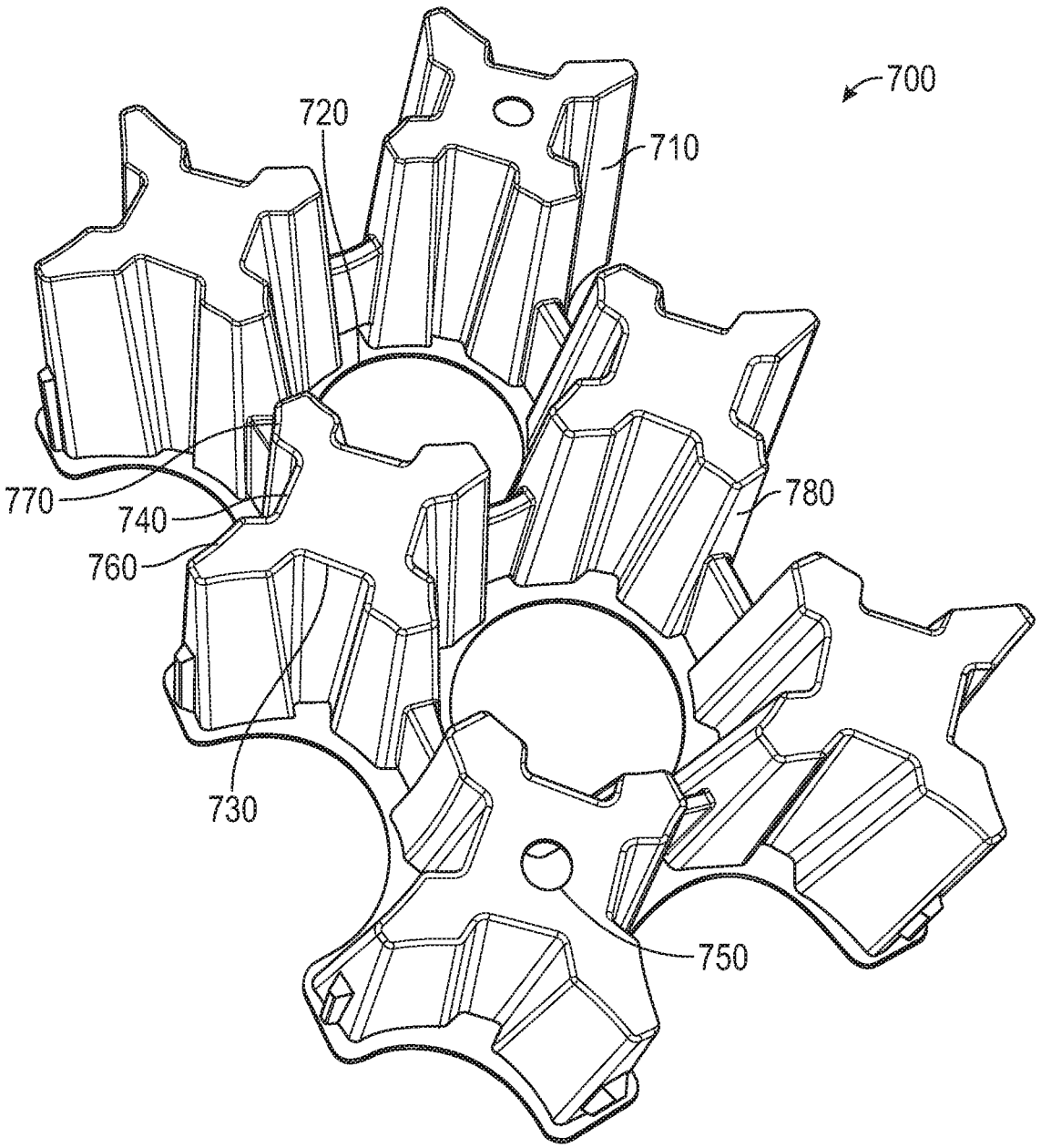
FIG. 7 depicts a bottom side of a center support according to various embodiments.

FIG. 7 depicts a bottom side of a center support according to various embodiments. In the example shown, a bottom side of center support 700 (e.g., center support 600 of FIG. 6, center support 130 of FIGS. 1-2) includes a plurality of exterior support cavities 710, interior support cavities 720, and/or other elements. The exterior support cavities 710 and interior support cavities 720 may be bounded by star-shaped posts 730 (e.g., star-shaped elements, cross-shaped contoured posts). The star-shaped posts 730 may include a diamond-shaped inner portion 740 (e.g., square and/or rectangular shaped inner portion) and star point elements 760, 770 (e.g., star point elements) that extend away from the center of the post 730 at, for example, ninety degree angles (e.g., orthogonal to one another) to form the rough shape of a star and/or cross. In certain cases, star point elements 760 extending toward another post may be smaller in size that star point elements 770 extending towards an edge of the bottle packaging assembly. The larger star point elements 770 may extend further to encapsulate a portion of the outer surface of a bottle, thereby separating adjacent bottles and preventing adjacent bottles from contacting one another. In certain cases, a center support 700 includes recessed elements 780 elements between the posts 730. The recessed elements 780 between posts 730 allow the posts 730 to tilt relative to one another and the center support 700 to flex during use. In certain cases, one or more posts 730 include a hole 750 to reduce a vacuum when multiple center supports are stacked (e.g., during manufacture).

In some embodiments, a center support 700 is placed on a bottom tray (e.g., bottom tray 110 of FIGS. 1-3) when, for example, beverage containers are prepared for shipping. In some cases, the star-shape elements 730 are placed on posts included in a bottom tray (e.g., posts 114 of bottom tray 110 of FIG. 3). During assembly a flat surface of each post 730 contacts a flat surface of a post on the bottom tray (e.g., posts 114 or deformable post elements 116 of bottom tray 110 of FIG. 3). The bottom tray 110 may include six posts to accommodate the six posts 730 of the center support 700.

Figure 8:
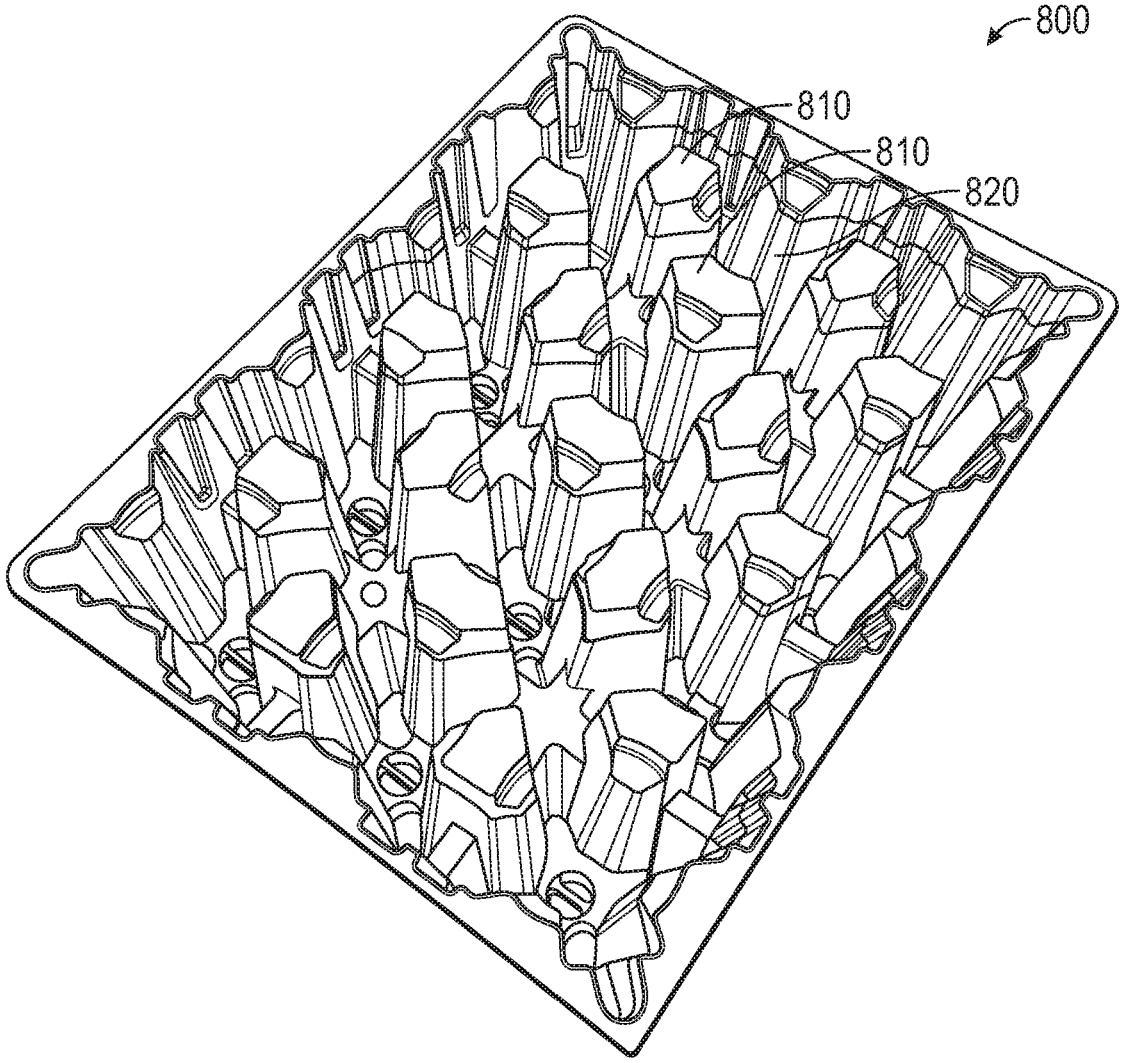
FIG. 8 depicts a top tray of a beverage container packaging assembly according to some embodiments.

FIG. 8 depicts a top tray of a beverage container packaging assembly according to some embodiments. In the example shown, a top tray 800 (e.g., top tray 120 of FIG. 1) includes multiple vertical posts 810. In certain cases, the vertical posts 810 form the sides (bounds) of bottle neck accommodating spaces 820 in the top tray 800. The bottle neck accommodating spaces are configured to accommodate a neck of a beverage container, such as a wine bottle. The number of bottle neck accommodating spaces 820 corresponds to a number of beverage containers the top tray 800 is configured to accommodate. In the example shown, the top tray 800 includes twelve bottle neck accommodating spaces 820—three (3) rows of four (4) bottle neck accommodating spaces—and the top tray 800 is configured to accommodate twelve beverage containers.

Figure 9:
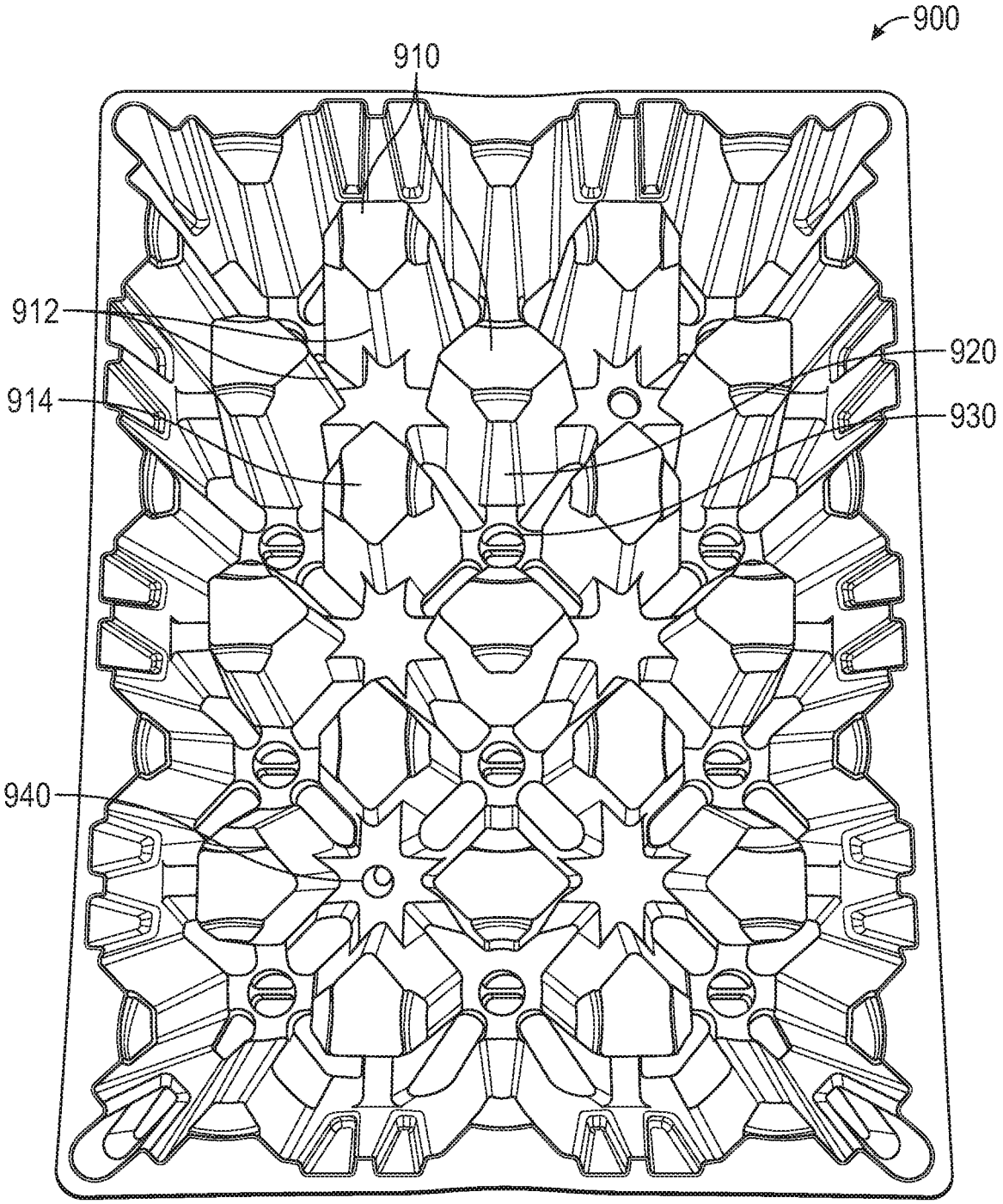
FIG. 9 depicts a first view of a top tray according to some embodiments.

FIG. 9 depicts a first view of a top tray according to some embodiments. In the example shown, a top tray 900 includes multiple vertical posts 910 that form bottle neck accommodating spaces 920. For example, the vertical posts 910 may include deformable elements 912 that contact the neck of a bottle and hold it in place during shipping. The deformable elements 912 may also deform to absorb lateral loads applied to a bottle during transit. In some cases, the vertical posts 910 may include trapezoidal deformable elements 914 (e.g., protrusions) on a top of the vertical post 910. The trapezoidal elements 914 may contact portions of the center support structure, such as corners 632 of the star-shaped cavities 630 of FIG. 6.

In certain cases, a top end of the bottle neck accommodating spaces 920 includes a circular depression 930 (e.g., circular depressed region). The circular depression 930 may accommodate the size of wine cork such that the wine bottle rim contacts the top tray but not the cork, for example, when a load is applied down on the top tray 900. The circular depression 930 may include a thin deformable element bisecting the circular depression 930.

In some embodiments, the top tray 900 includes one or more holes 940. Similar to the holes discussed with respect to other components of bottle packaging assembly, the holes 940 reduce vacuum generated when the top tray is placed into a box.

Figure 10:
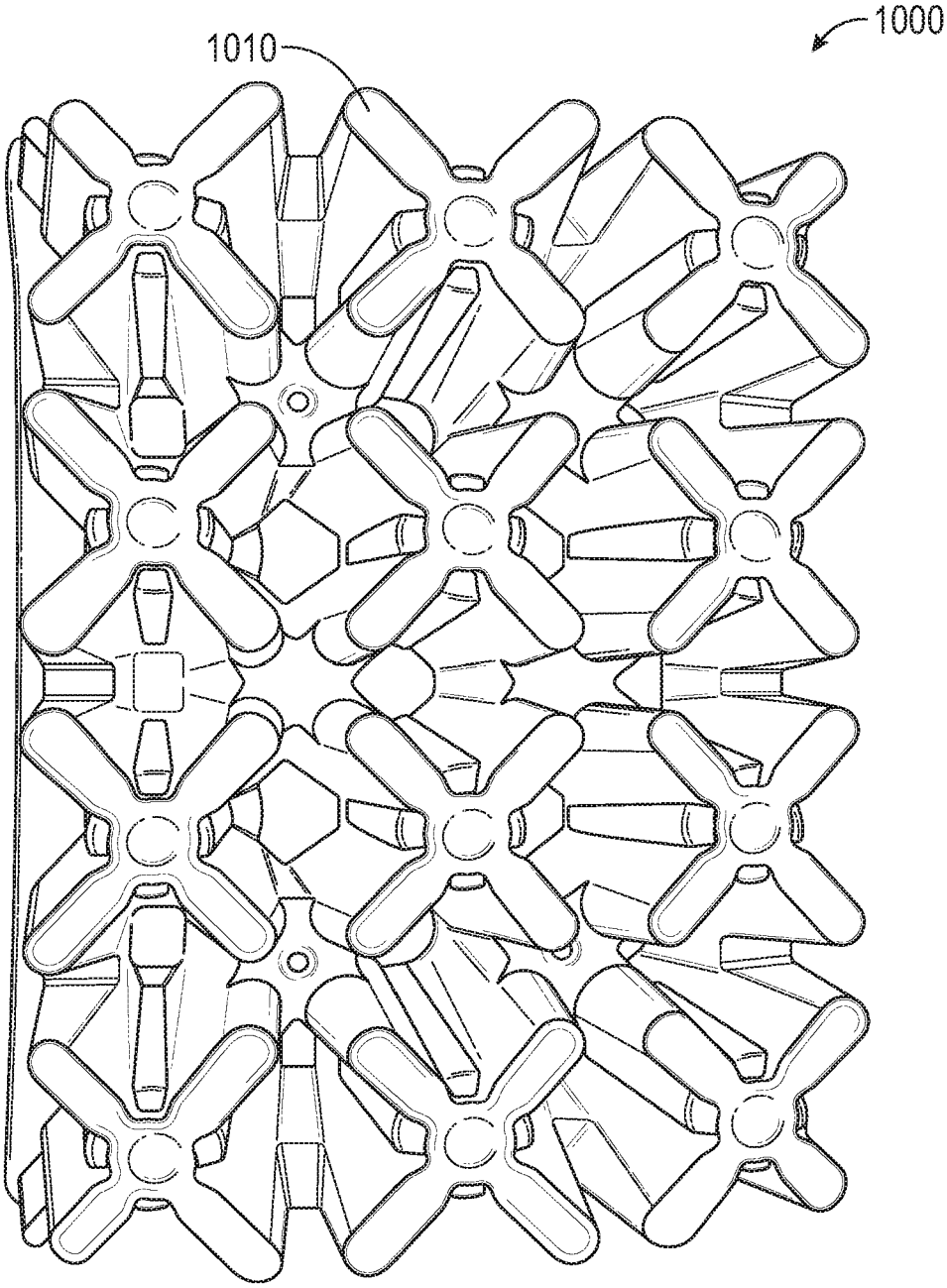
FIG. 10 depicts a second view of a top tray according to various embodiments.

FIG. 10 depicts a second view of a top tray according to various embodiments. In the example shown, a top tray 1000 includes the structure underlying the bottle neck accommodating spaces (e.g., bottle neck accommodating spaces 920 of FIG. 9). The top side (on assembly) of the top tray 1000 includes non-contoured pulp paper. The top side of the bottle neck accommodating spaces may include cross-shaped protrusions 1010 (e.g., four protrusions meeting at a point in the example shown). The cross-shaped protrusions 1010 may absorb impact and reduce loads applied to the beverage containers during, for example, an impact event.

Figure 11:
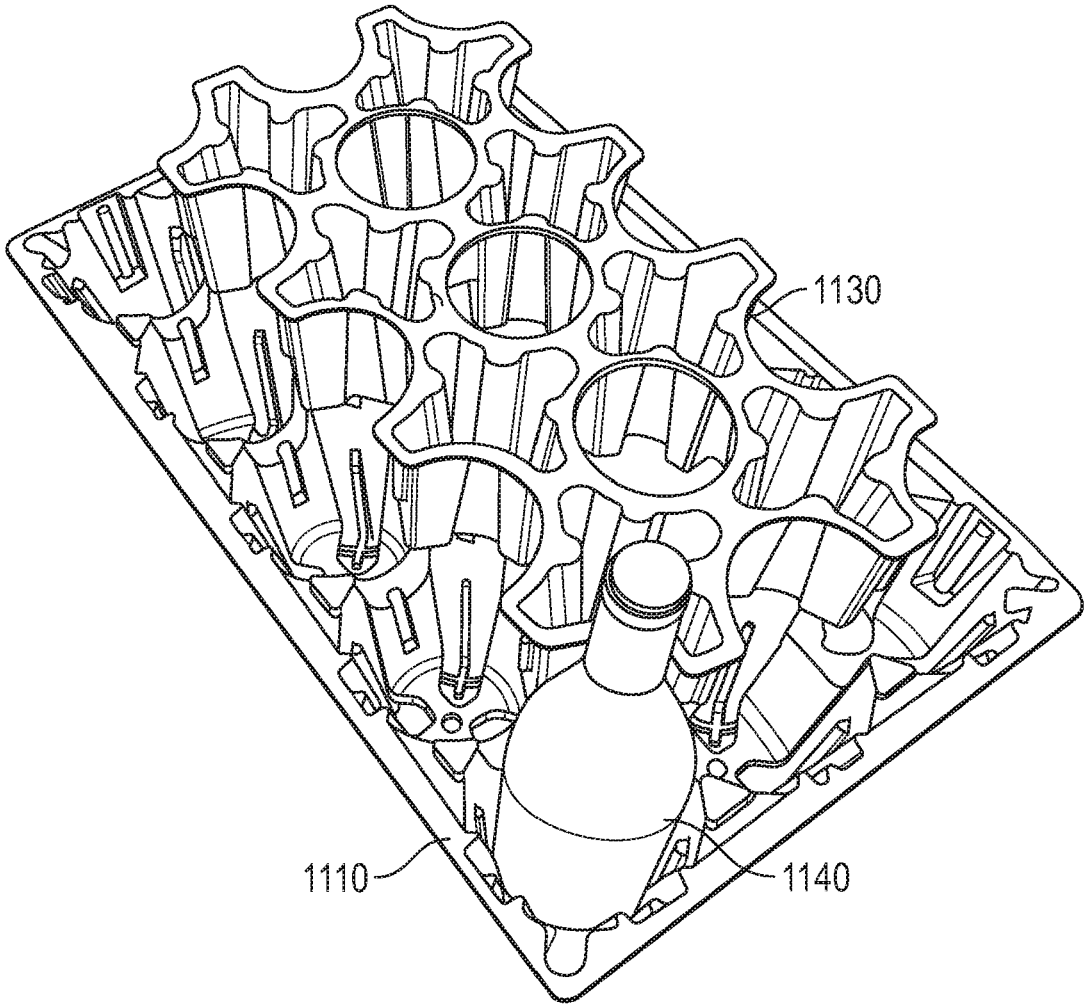
FIG. 11 depicts a bottom tray and center support of a beverage container packaging assembly according to various embodiments.

FIG. 11 depicts a bottom tray and center support of a beverage container packaging assembly according to various embodiments. In the example shown, a beverage container 1140 is seated in a cup-shaped element of a bottom tray 1110. A center support 1130 is seated upon the lower tray 1110. The lower tray 1110 is similar to bottom tray 110 of FIGS. 1-3, bottom tray 400 of FIG. 4, and bottom tray 500 of FIG. 5. One difference being the bottom tray 1010 is configured to accommodate fifteen beverage containers—three rows of five containers—as opposed to twelve in the bottom trays 110, 400, 500 of FIGS. 1-5. The center support 1030 is similar to the center supports 130, 600, 700 of FIGS. 2, 6, and 7, respectively, with the exception that center support 1030 is configured to accommodate fifteen beverage containers—three rows of five containers—as opposed to twelve.

Figure 12:
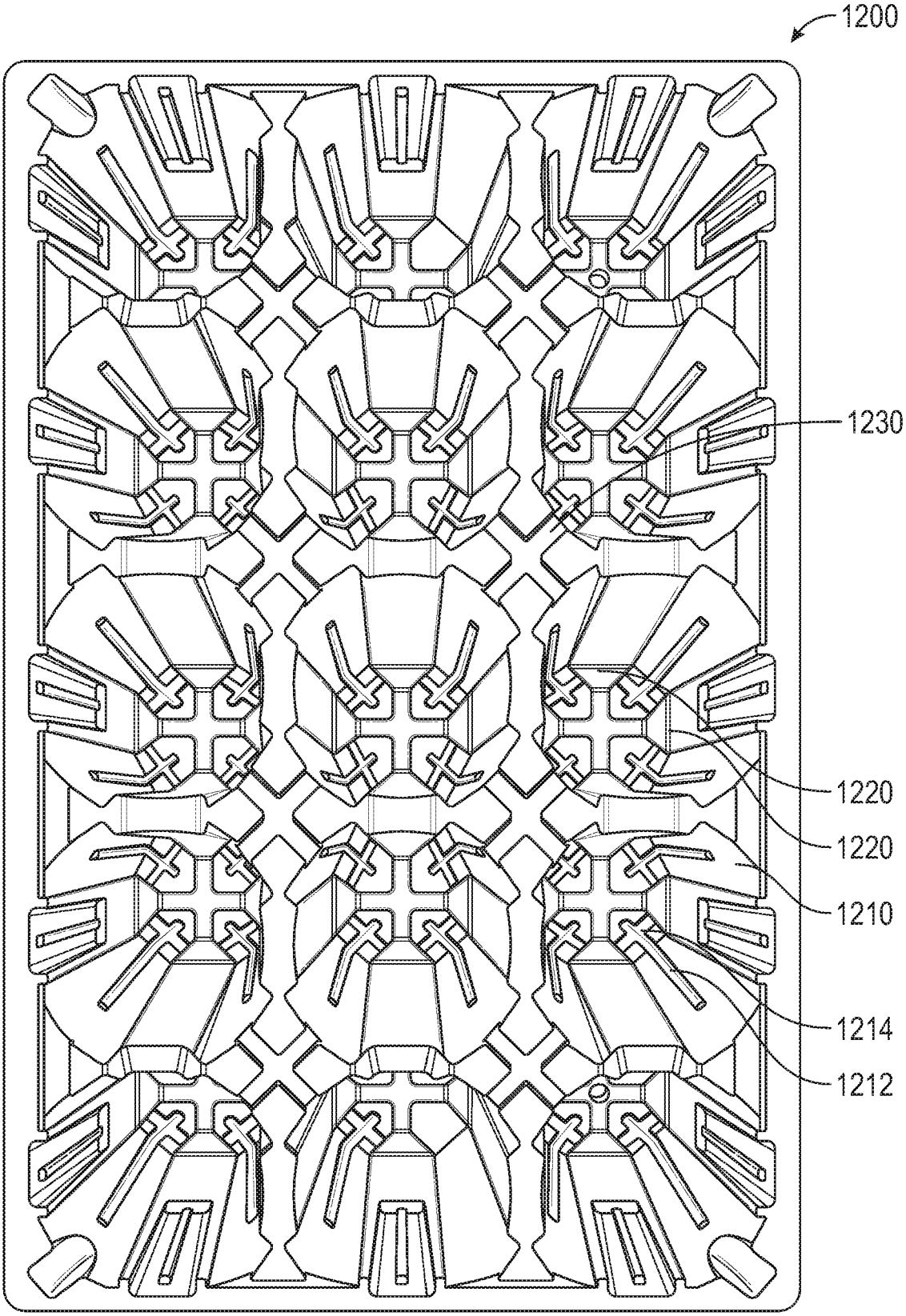
FIG. 12 depicts a bottom tray according to various embodiments.

FIG. 12 depicts a bottom tray according to various embodiments. The bottom tray 1200 depicted is similar to bottom trays to bottom tray 110 of FIGS. 1-3, bottom tray 400 of FIG. 4, and bottom tray 500 of FIG. 5. For the sake of brevity and clarity, the following description will focus primarily on the differences relative to the aforementioned bottom trays 110, 400, and 500. In the example shown, a bottom tray 1200 includes a plurality of cup-shaped elements 1210, posts 1230 (e.g., eight posts). The cup shaped element 1210 includes multiple thin deformable elements 1212. In certain cases, the thin deformable elements 1212 extend from a center of the cup-shaped element up a side of the cup-shaped element 1210. The thin deformable elements terminate at the bottom of the cup-shaped element 1210 in a cross shape end 214 (e.g., cross shape element). The cross-shaped ends 1214 may assist in absorbing impact from a bottom of bottle when, for example, an assembly is dropped. The cross-shaped ends 1214 may reduce damage to the end of thin deformable element 1212 when, for example, the bottom tray 1200 is bent. The cross-shaped ends 1214 eliminate a stress concentration point and allow load to be distributed to other elements when the bottom tray 1200 is bent or otherwise loaded.

In various embodiments, the cup-shaped elements 1210 elements include rounded corners 1220 at a base of the cup-shaped elements 1210. The rounded corners 1220 may allow the bottom tray 1200 to endure more repeated loading. The rounded corners 1220 also accommodate the shape of the bottom of a bottle.

Figure 13:
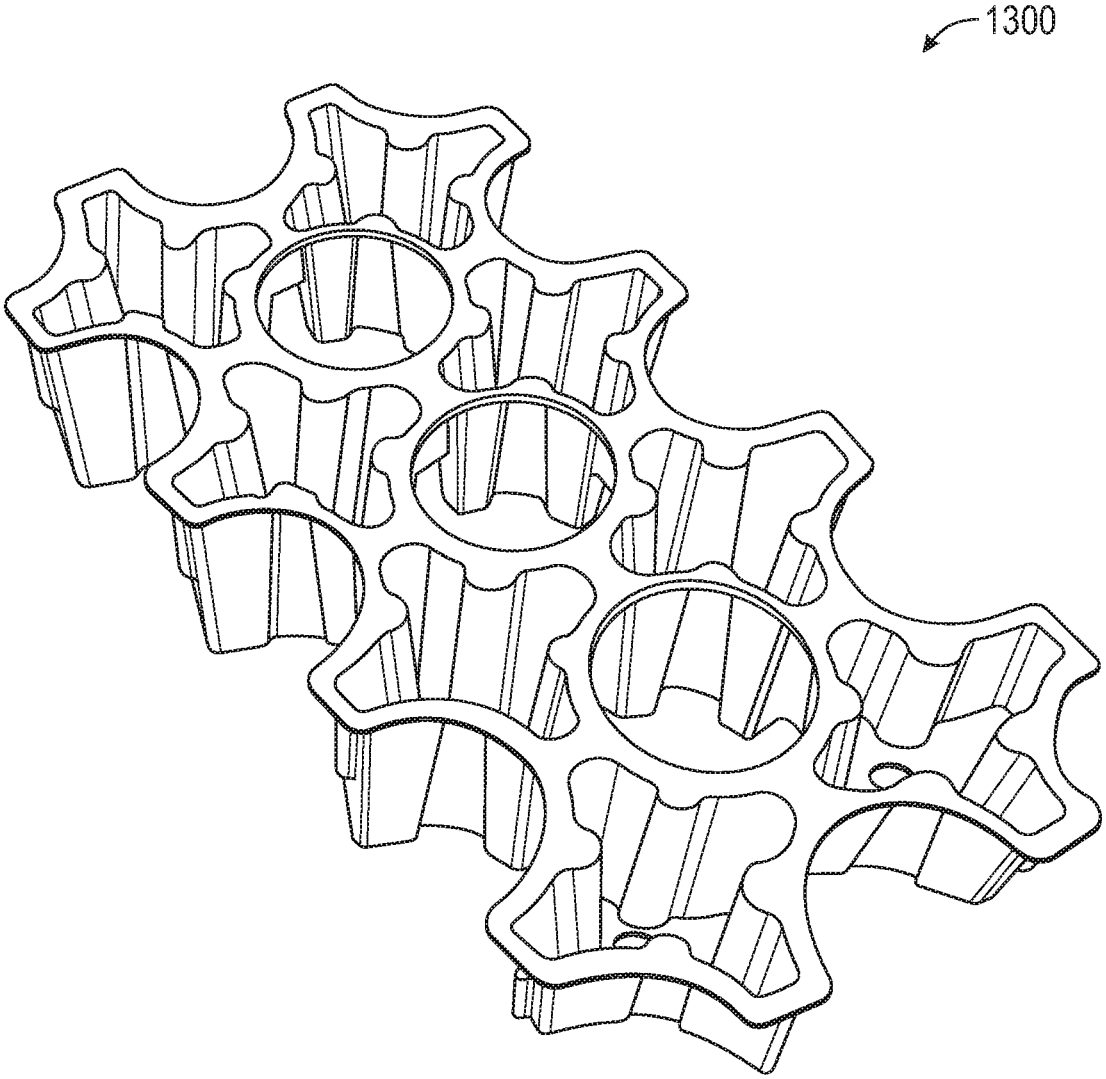
FIG. 13 depicts a center support according to various embodiments.

FIG. 13 depicts a center support according to various embodiments. The center support 1300 shown is similar to the center supports 130, 600, 700 of FIGS. 2, 6, and 7, respectively, with the a difference being the center support 1300 is configured to accommodate fifteen beverage containers—three rows of five containers—as opposed to twelve.

Figure 14:
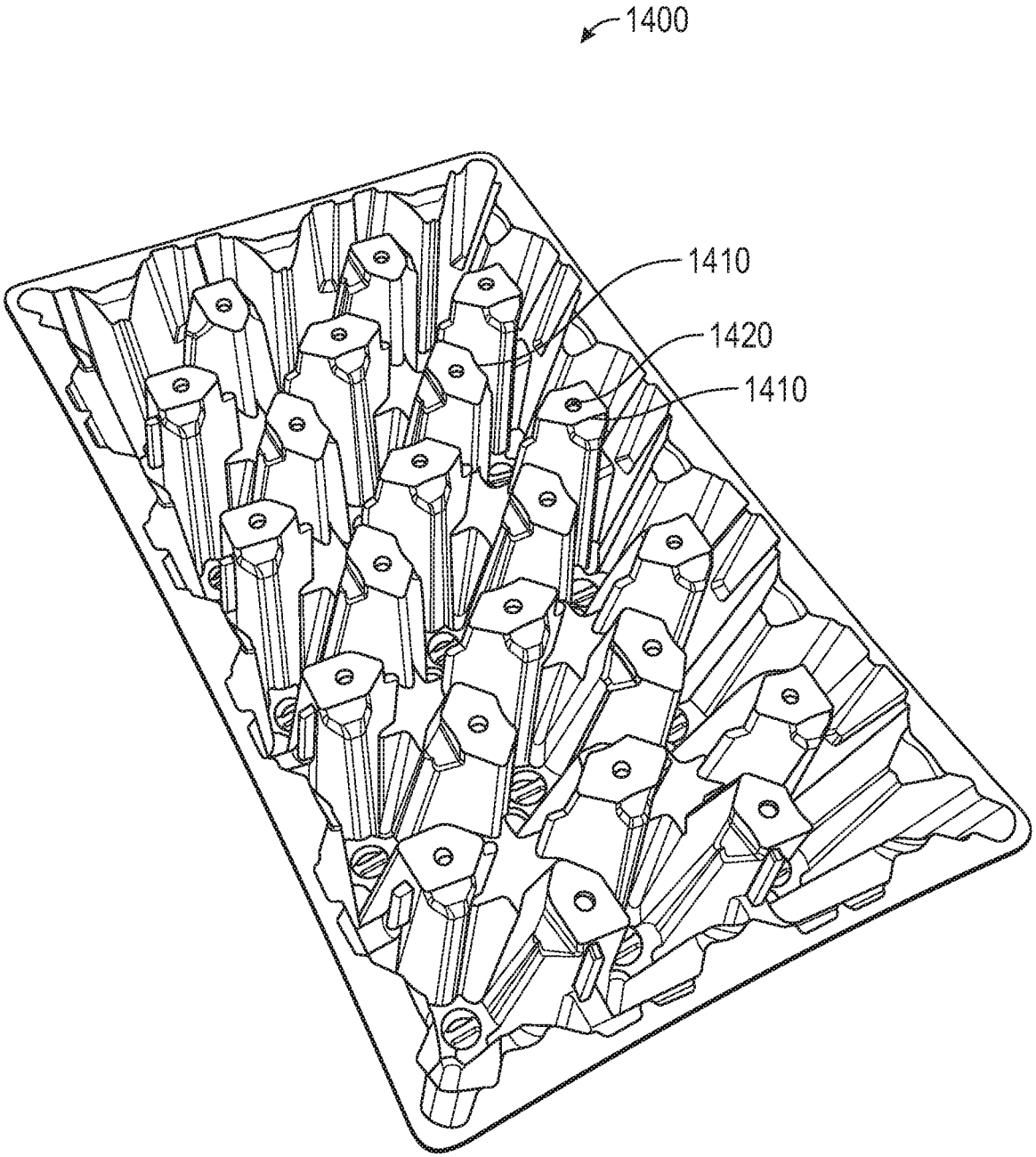
FIG. 14 depicts a top tray according to various embodiments.

FIG. 14 depicts a top tray according to various embodiments. The top tray 1400 shown is similar to top trays 120, 800, 900, and 1000 of FIGS. 1, 8, 9, and 10. One difference between the top tray 1400 depicted is configured to accommodate fifteen beverage containers—three rows of five containers—as opposed to twelve as in top trays 120, 800, 900, 1000. In certain cases, top tray 1400 includes a plurality of posts 1410 each including holes 1420 in a top flat surface of the posts 1410. The holes 1420 reduce any vacuum effect as the top tray is loaded into a box.

Figure 15:
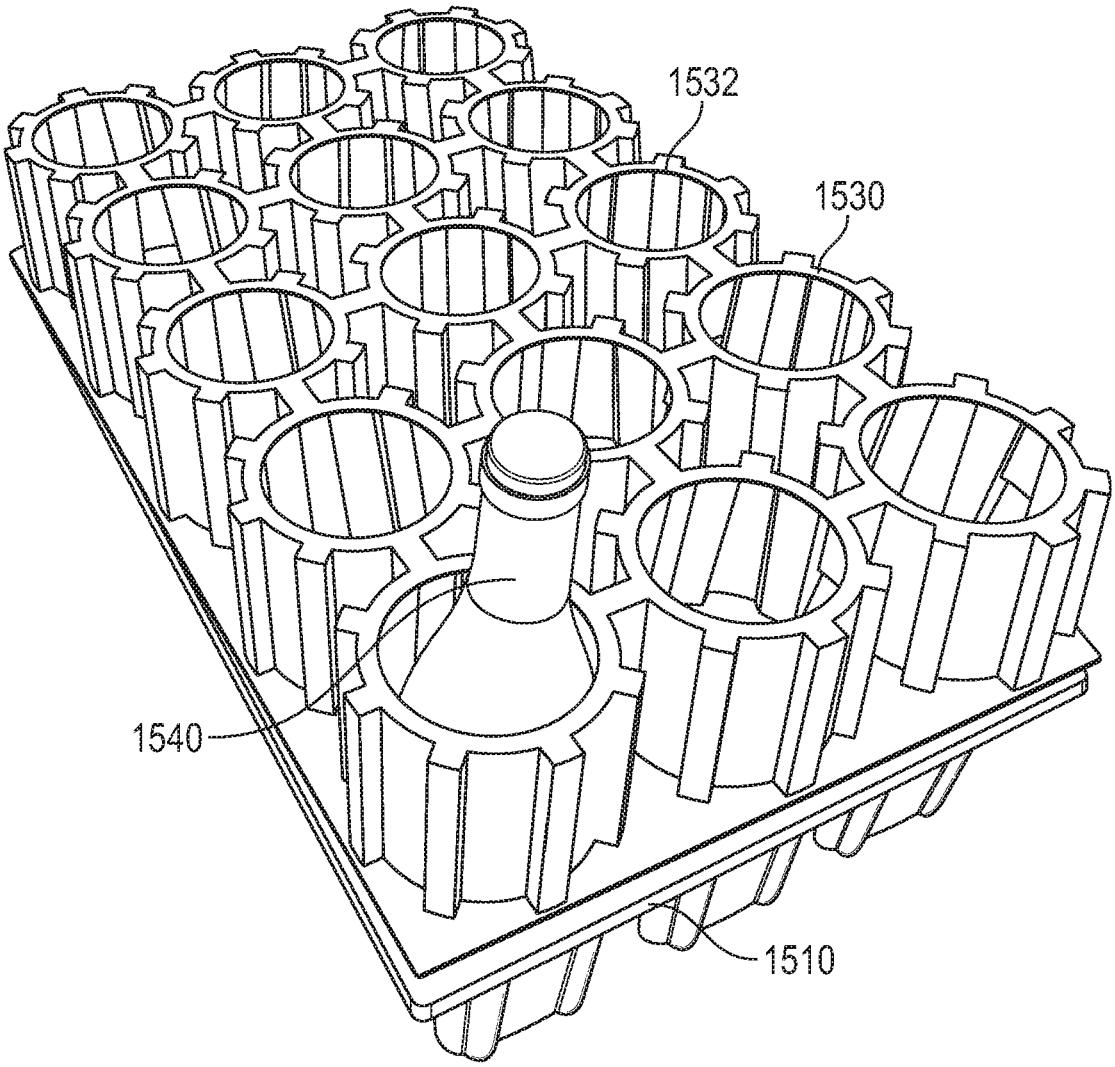
FIG. 15 depicts a bottom tray and center support of a beverage container packaging assembly according to various embodiments.

FIG. 15 depicts a bottom tray and center support of a beverage container packaging assembly according to various embodiments. In the example shown, a beverage container 1540 is seated in a cup-shaped element of a lower tray 1510. A center support 1530 is seated upon the bottom tray 1510. The bottom tray 1510 is similar to bottom tray 1110, 1200 of FIGS. 11 and 12. Center support 1530 is similar to center support 1300 of FIG. 13, with the exception that the center support 1530 includes bottle enclosure cavities 1532 that fully encapsulate each beverage container 1540.

In various embodiments, the beverage container enclosure cavities 1532 protect the beverage container 1540 from side impacts, maintain the beverage container 1540 upright during transit, and/or provide other benefits. In certain cases, a bottle packaging assembly (e.g., bottom tray 1510, center support 1530, and top tray 1400 of FIG. 14) may be able withstand 15 drops from at least 18 inches, two drops from 36 inches, and/or 10 drops from 30 inches, as required by various shipping companies (e.g., United Parcel Service (UPS), FedEx, and the like).

Figure 16:
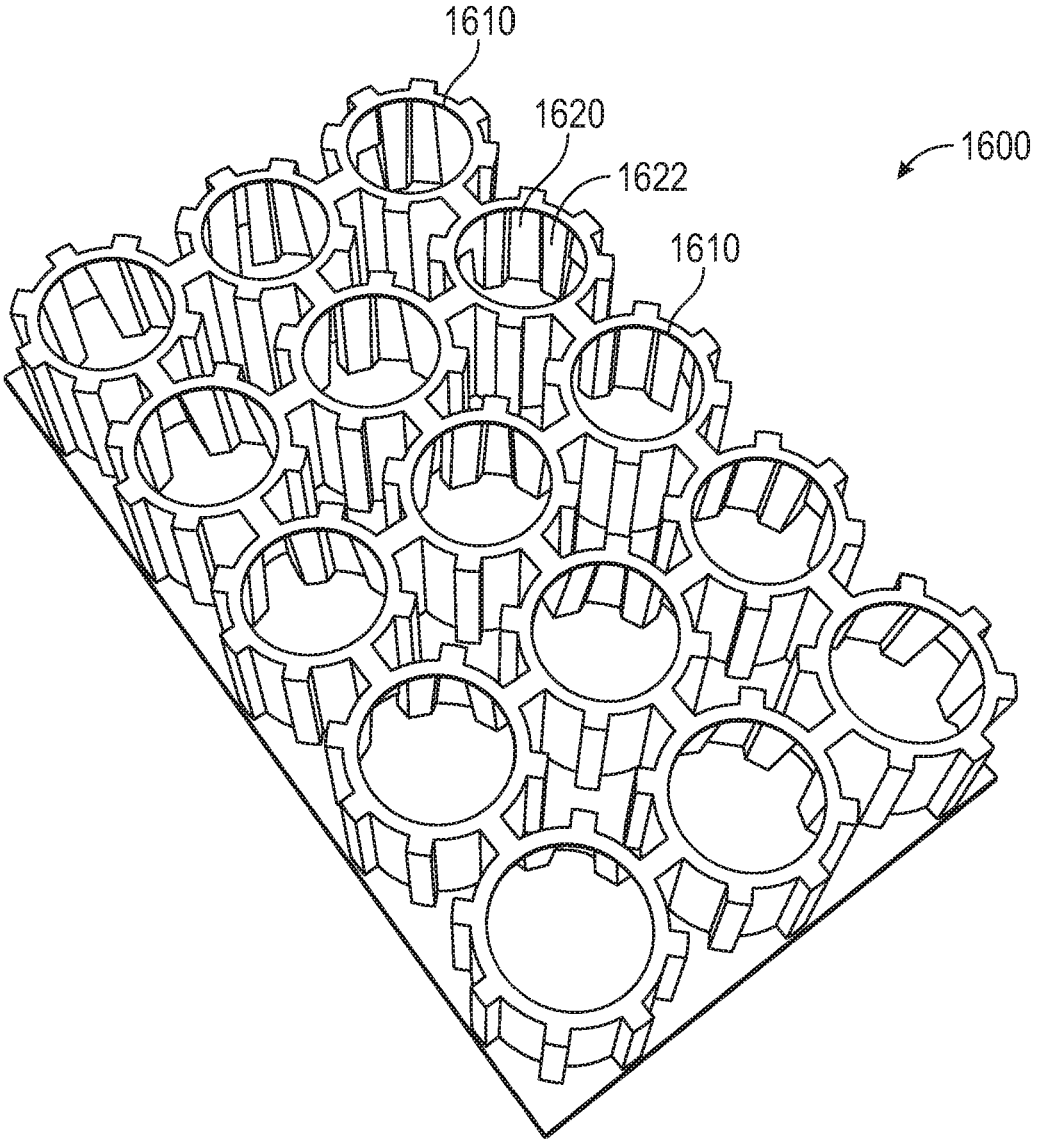
FIG. 16 depicts a center support according to various embodiments.

FIG. 16 depicts a center support according to various embodiments. In the example shown, a center support 1600 includes a plurality of beverage container enclosure cavities 1610 (e.g., interior support cavities). The enclosure cavities 1610 function to maintain the bottle upright and to separate each bottle from adjacent bottles. The enclosure cavities 1610 may include a circular (cylindrical) enclosure. The enclosure cavities 1610 may fully encapsulate (surround) a neck, shoulder, body and/or other component of a beverage container. Walls 1620 of the enclosure cavities 1610 may include a draft angle, such as seven degrees and/or another draft angle.

In some embodiments, the walls 1620 of the enclosure cavities 1610 include deformable elements 1622. The deformable elements 1622 are configured to absorb load applied to the side of a beverage container, thereby protecting beverage container from damage during transit. Because the beverage containers are each fully encapsulated by enclosure cavities 1610, the center support 1600 and beverage containers included therein may withstand higher loads and/or more load cycles than center support 1300 of FIG. 13.

Figure 17:
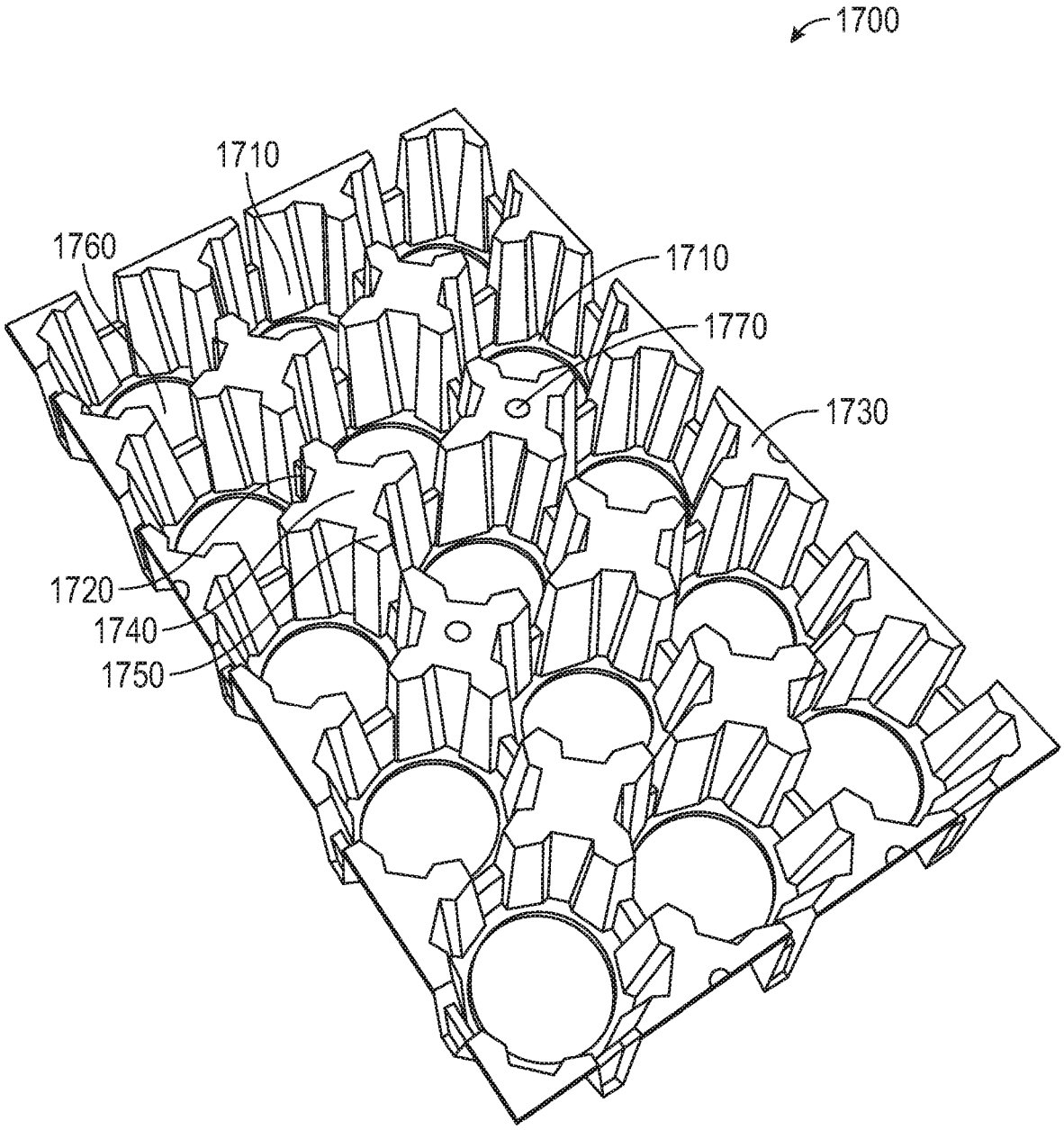
FIG. 17 depicts a bottom view of a center support according to various embodiments.

FIG. 17 depicts a bottom view of a center support according to various embodiments. In the example shown, a bottom side of center support 1700 (e.g., center support 1600 of FIG. 16, center support 1530 of FIG. 15) includes a plurality of beverage container enclosures 1710 (e.g., enclosure cavities). The beverage container enclosure cavities 1710 may be bounded by star-shaped posts 1720 (e.g., star-shaped elements) and/or partial star-shaped posts 1730 (e.g., partial star-shaped elements). The star-shaped posts 1720 may include a diamond-shaped inner portion 1740 (e.g., square and/or rectangular shaped inner portion) and four outer portions 1750 (e.g., star point elements, cross arm elements) extend away from the center of the post 1720 at rough ninety degree angles (e.g., orthogonal to one another) to form the rough shape of a cross. In certain star point elements 1750 may include different sizes.

In certain cases, a center support 1700 includes recessed elements 1760 elements between posts 1720. The recessed elements 1760 between posts 1720 allow the posts 1720 to tilt relative to one another and the center support 700 to flex during use. In certain cases, one or more posts 1720 include a hole 1770 to reduce a vacuum when multiple center supports are stacked (e.g., during manufacture).

In some embodiments, a center support 1700 is placed on a bottom tray element (e.g., bottom tray element 1110, 1200, 1510 of FIGS. 11, 12, and 15) when a beverage container packaging assembly is prepared for shipping. In some cases, the posts 1720 are placed on posts included in a bottom tray (e.g., posts 114 and/or platforms 116 of bottom tray 110 of FIG. 3). During assembly a flat surface of each post 1720 contacts a flat surface of a post on the bottom tray (e.g., posts 1230 of bottom tray 1200 of FIG. 12). The bottom tray 1200 may include eight posts 1230 to accommodate the eight internal posts 1720 of the center support 1700.

Figure 18:
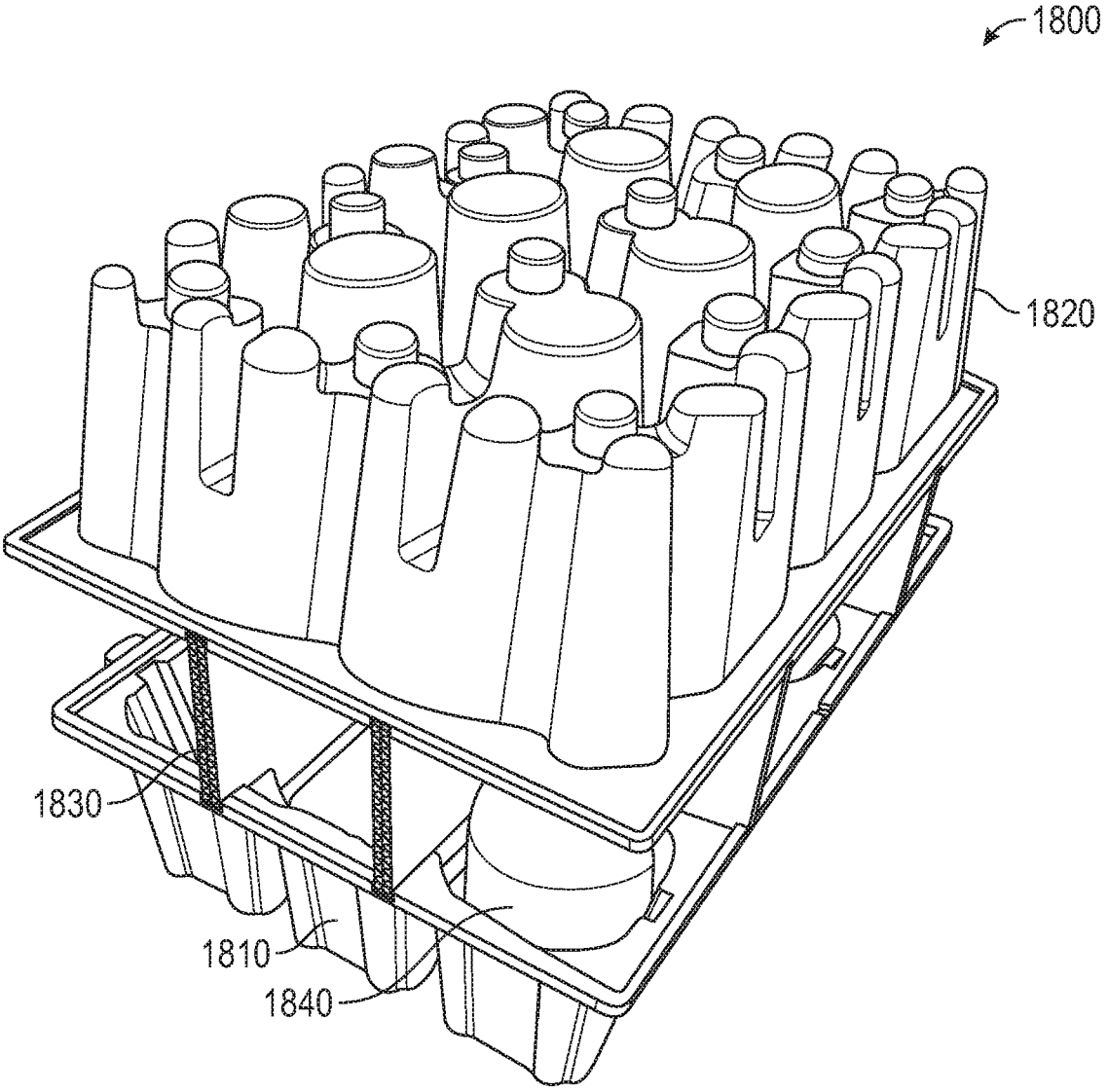
FIG. 18 depicts a beverage container packaging assembly according to various embodiments.

FIG. 18 depicts a beverage container packaging assembly according to various embodiments. In the example shown, a beverage container packaging assembly 1800 may include a bottom tray 1810 (e.g., bottom element), a top tray 1820 (e.g., a top element), a center support 1830 (e.g., partition element, center support element), and/or other components. The beverage container packaging assembly 1800 is configured to package a plurality of beverage containers 1840 for transit. The base of the beverage container 1840 sits in one of the cylindrical cup-shaped elements of the bottom tray 1810. The center support 1830 separates the bottom tray 1810 and top tray 1820. The top tray 1820 rests on the center support 1830. The top of the beverage container 1840 is encapsulated in a rectangular cup-shaped element of the top tray 1820. The center support 1830 prevents the sides of the beverage containers 1840 from contacting during shipping and provides spacing between the bottom tray 1810 and top tray 1820. In certain cases, the center support 1830 may not be included in the beverage container packaging assembly 1800.

Figure 19:
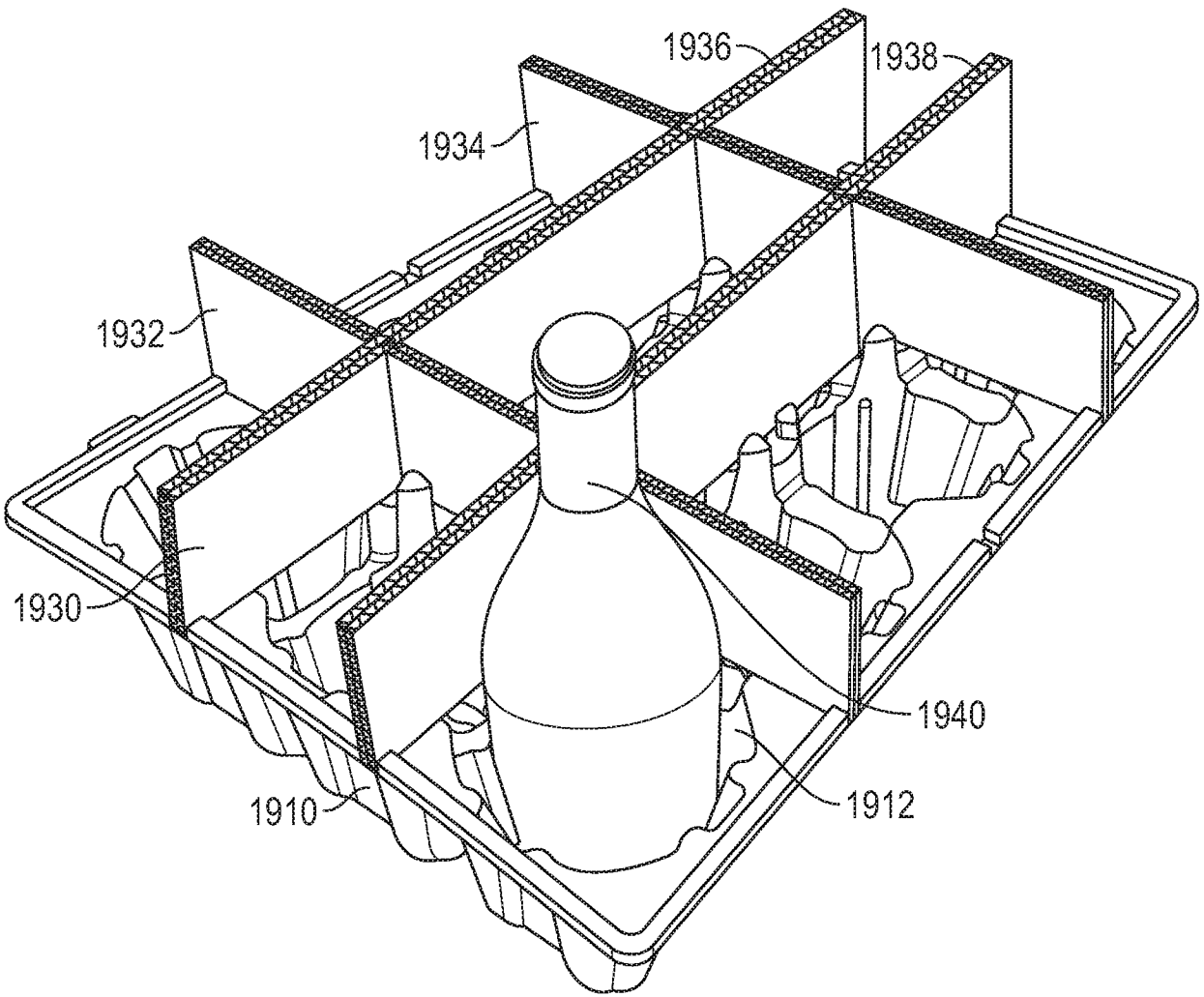
FIG. 19 depicts a bottom tray and center support of a beverage container packaging assembly according to various embodiments.

FIG. 19 depicts a bottom tray and center support of a beverage container packaging assembly according to various embodiments. In the example shown, a beverage container 1940 (e.g., wine bottle) is seated in a cup-shaped element 1912 of a lower tray 1910. The cup-shaped element 1912 is shaped to retain the beverage container 1940 in a vertical configuration during transit. In the example shown, a center support 1930 includes multiple cardboard elements—two laterally arranged cardboard elements 1932, 1934 and two transversely arranged cardboard elements 1936, 1938.

Figure 20:
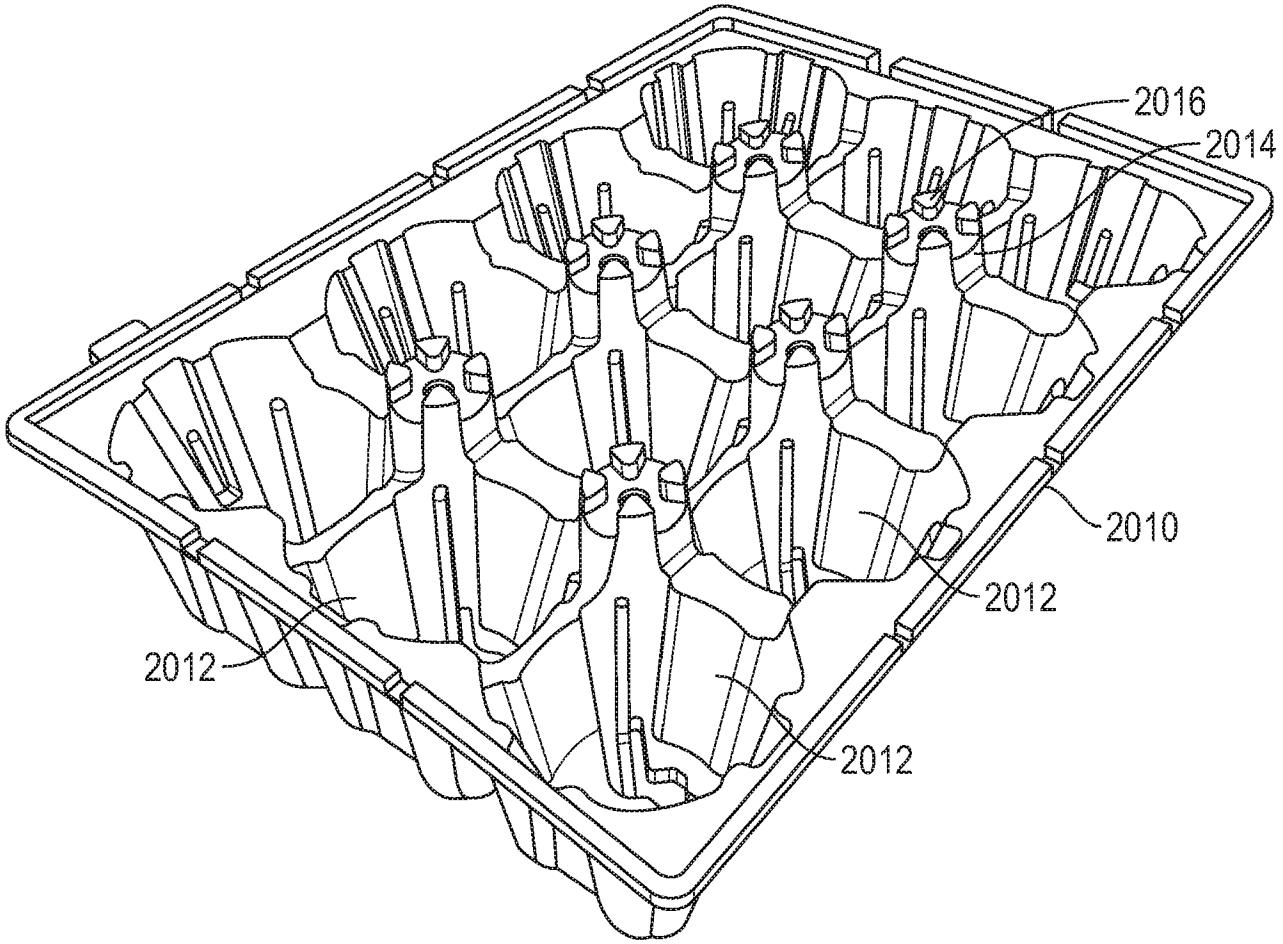
FIG. 20 depicts a bottom tray of a beverage container packaging assembly according to some embodiments.

FIG. 20 depicts a bottom tray of a beverage container packaging assembly according to some embodiments. As shown, a bottom tray 2010 includes a plurality of cup-shaped elements 2012. The number of cup-shaped elements 2012 corresponds to a number of beverage containers the bottom tray 2010 is configured to accommodate. In the example shown, the bottom tray 2010 includes twelve cup-shaped elements 2012—three (3) rows of four (4) cup-shaped elements 2012—and the bottom tray 2010 is configured to accommodate 12 beverage containers. FIG. 20 depicts one example configuration of cup-shaped elements. The present disclosure, however, is in no way limited to the depicted configuration of cup-shaped elements 2012 or number of cup-shaped elements 2012.

In certain cases, the bottom tray 2010 includes posts 2014 configured to support the center support (not shown). Each of the posts 2014 may include guide elements 2016 (e.g., protrusions) that form one or more channels to accommodate panels of the center support (not shown).

Figure 21:
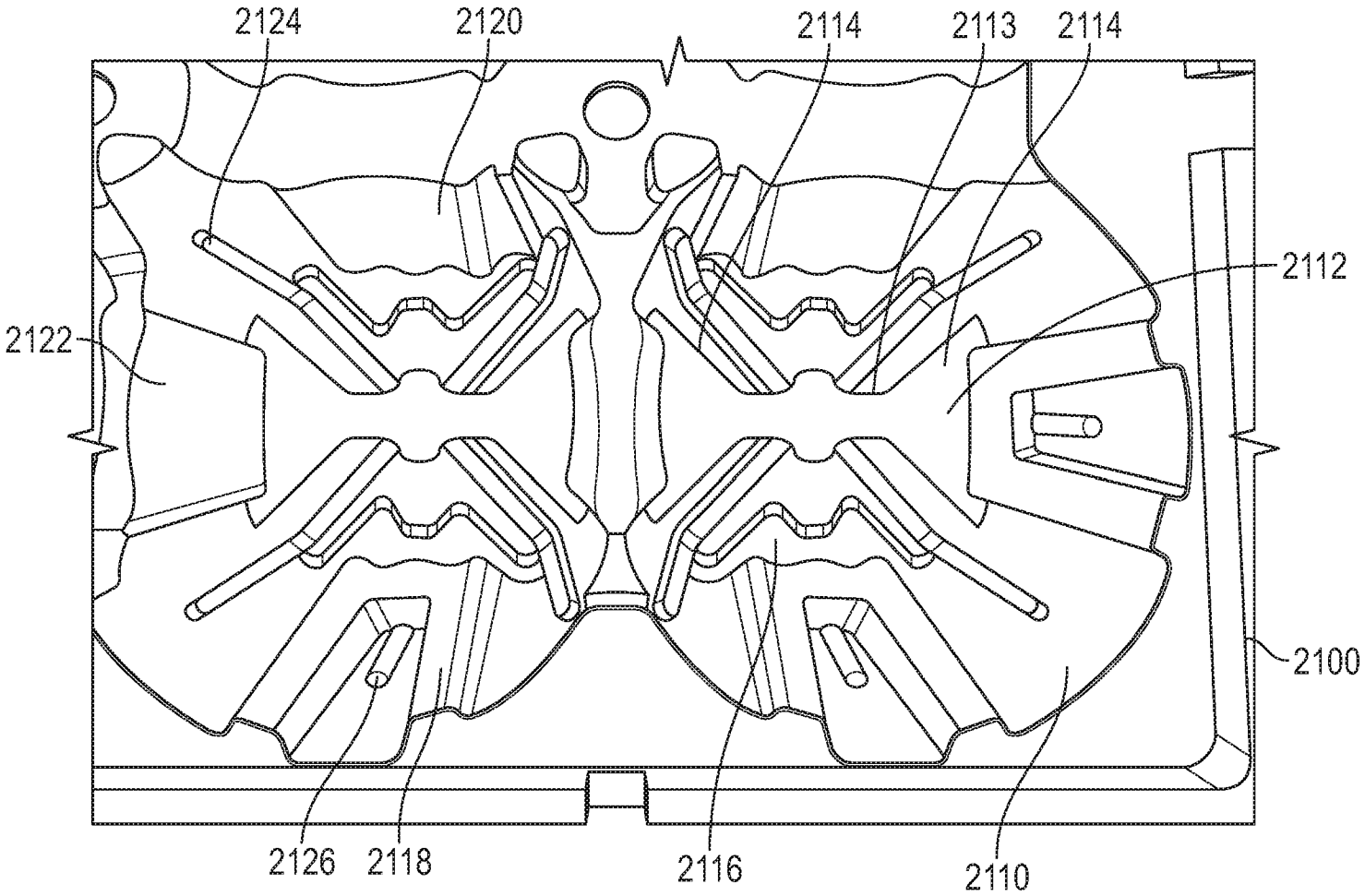
FIG. 21 depicts cup-shaped elements of a bottom tray according to various embodiments.

FIG. 21 depicts cup-shaped elements of a bottom tray according to various embodiments. In the example shown, a bottom tray 2100 (e.g., bottom tray 2010 of FIG. 20) may include cup-shaped elements 2110 (e.g., cup shaped element 1912, 2012 of FIGS. 19, 20) that are cylindrical and/or substantially cylindrical. The cup-shaped element may include a bottom portion and multiple side walls forming a cup shape. In certain cases, the side walls may not be exactly vertical but may include draft to enable the bottom tray 2100 to be easily removed from a mold during fabrication.

Each of multiple cup-shaped elements 2110 includes a first deformable element 2112 (e.g., an hourglass shaped element, bow-tie shaped element), second deformable elements 2116, vertical elements 2118, 2120, 2122, 2124, and other elements. The first deformable element 2112 may be raised (e.g., a protrusion) from the bottom surface of the cup-shaped element 2110. The first deformable element 2112 may resemble an hourglass, bow tie, or other similar shape. The first deformable element 2112 is configured to absorb impact applied to a top of a beverage container (not shown). The first deformable element 2112 may be particularly effective in absorbing impact from a bottle with a convex bottom surface, such as a wine bottle. Wider portions 2114 of the hourglass shaped element 2112 are configured to contact the outer edges of the bottom of a bottle, such as a wine bottle. Thinner portions 2113 of the hourglass shaped element 2112 allow the element to deform (for example, by bending, crumpling, and/or otherwise deforming) when a load is applied to a beverage container housed in the bottom tray 2100. The hourglass shaped element 2112 deforms to absorb load and reduce damage to a bottle, particularly when a load is applied down from the top on the bottle or when the assembly is dropped.

A cup-shaped element 2110 may include second deformable elements 2116. The second deformable elements 2116 may resemble two adjacent mountain peaks. Similar to the first deformable element 2112, the second deformable elements 2116 are configured to contact the outer edges of the bottom of a bottle, such as a wine bottle. When a load is applied to the top of the wine bottle, when the beverage container packaging is dropped, or when the bottle is otherwise subjected to a force, the second deformable elements 2116 are configured to absorb the load and/or energy of the load by, for example, crushing, buckling, and/or otherwise deforming.

In various embodiments, the cup-shaped element 2110 includes multiple vertical deformable elements 2118, 2120, 2122. The vertical deformable elements 2118, 2120, 2122 contact the sides of a beverage container (not shown). In certain cases, first vertical elements 2118, second vertical elements 2120, and third vertical elements 2122 are configured to contact the outside of a bottle. The first vertical elements 2118, second vertical elements 2120, and third vertical elements 2122 may be sized, such that a bottle contacts all of the vertical elements 2118, 2120, 2122 when loaded into the cup-shaped element 2110. The bottle (not shown) and vertical deformable elements 2118, 2120, 2122 may contact one another in an interference fit, such that a force is necessary to push the bottle into the cup-shaped element 2110 and a force is necessary to remove the bottle from the cup-shaped element 2110. Securing the bottle in the cup-shaped element 2110 in such a manner ensures that the bottle is stationary during transit, thereby reducing any potential damage.

According to some embodiments, the cup-shaped element 2110 includes multiple thin deformable elements 2124, 2126. In certain cases, four thin deformable elements 2124 may extend from a center of the cup-shaped element up a side of the cup-shaped element 2110. The four first deformable elements 2124 may include thin protrusions spaced roughly 90 degrees apart from one another. The thin deformable elements 2124 may collectively form an X-shape, with each thin deformable element 2124 extending from the center of the X along the bottom and up a side wall. In certain cases, a portion of a first deformable element 2124 extending along the wall of the cup-shaped element 2110 may extend further from the surface than a portion of the thin deformable element spanning the bottom of the cup-shaped element 2110. In other words, the portion of the thin deformable element 2124 spanning the wall may be taller (higher) than the portion spanning the bottom of the cup-shaped element 2110. In some embodiments, second thin deformable elements 2126 may be disposed between vertical elements 2118. Similar to the vertical elements, thin deformable elements 2124, 2126 are configured to absorb impact energy and/or loads applied to the sides of the bottle. The thin deformable elements 2124, 2126 prevent damage to the bottom and sides of the bottle.

Figure 22:
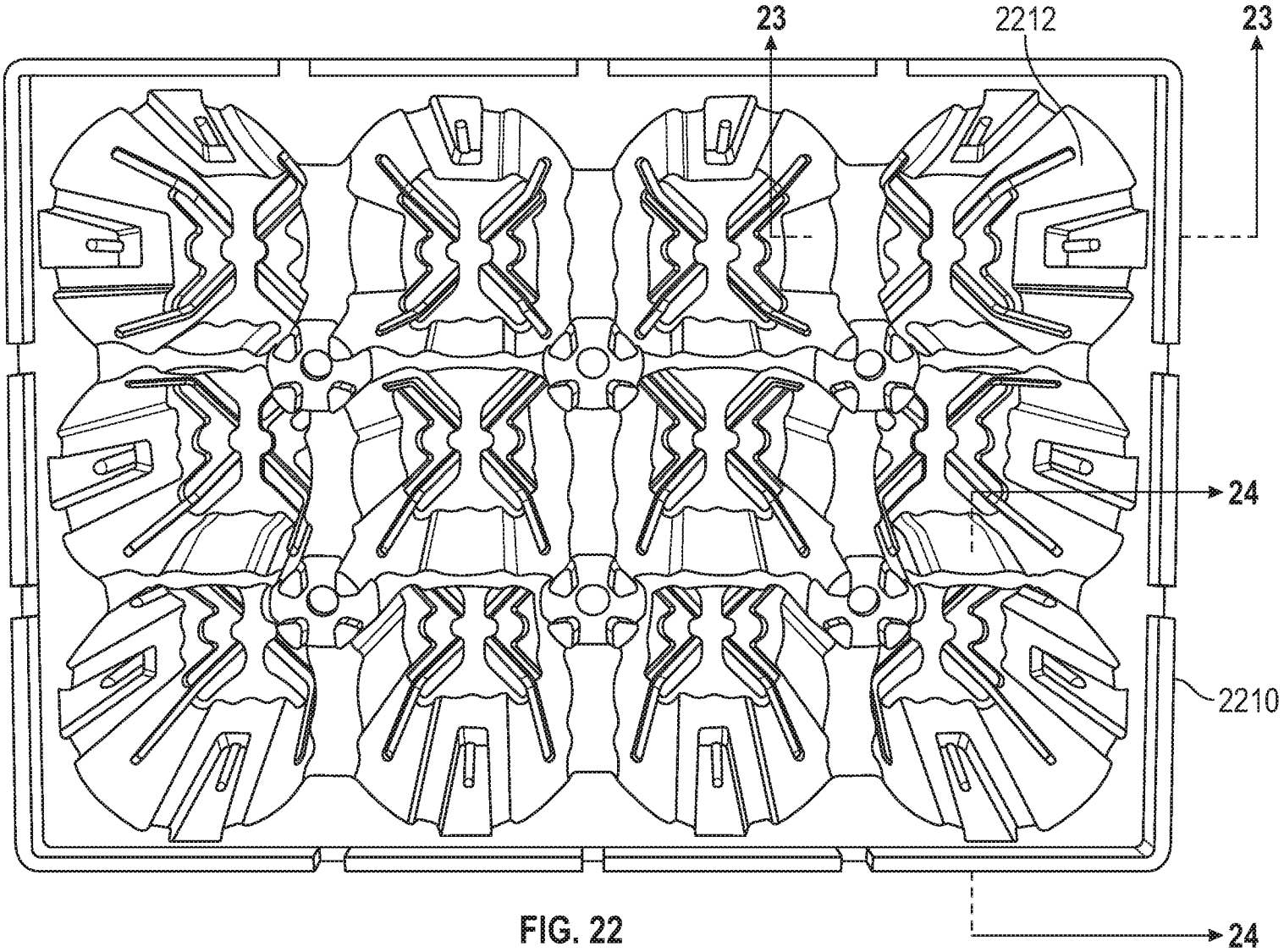
FIG. 22 depicts a bottom tray of a beverage container packaging assembly according to various embodiments.
Figure 23:
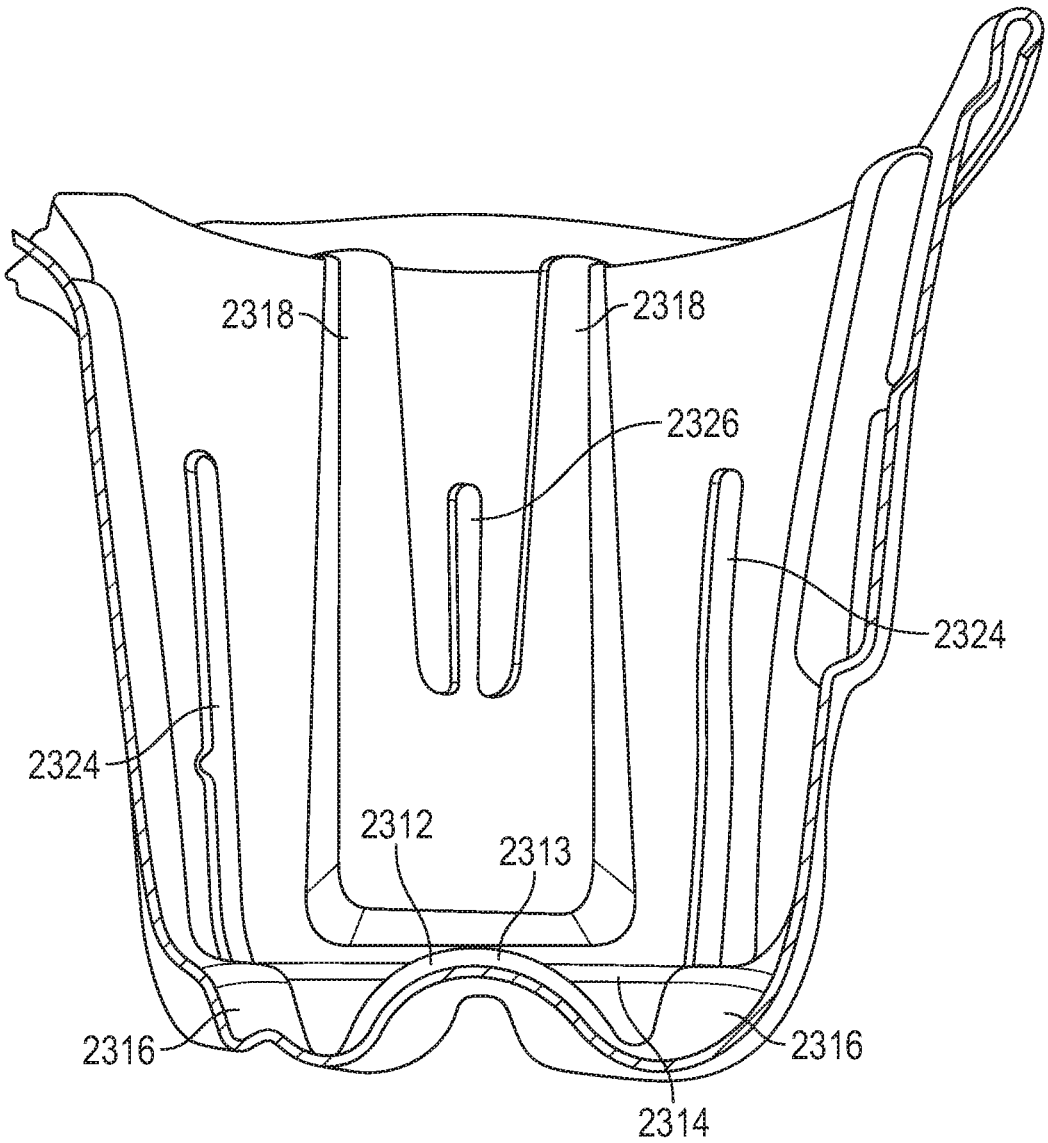
FIG. 23 depicts a first cross-section view of a cup-shaped element of a bottom tray according to various embodiments.

FIG. 22 depicts a bottom tray of a beverage container packaging assembly according to various embodiments. A first cross-section A-A depicts a cross-section of the cup-shaped element 2212 of the bottom tray in a first direction. The first cross-section A-A is depicted in FIG. 23. A second cross section B-B depicts a cross-section of the cup-shaped element 2212 in a direction perpendicular to the first direction. The second cross-section B-B is depicted in FIG. 24.

FIG. 23 depicts a first cross-section view of a cup-shaped element of a bottom tray according to various embodiments. FIG. 23 includes a cross-section view along section A-A as shown in FIG. 22. In the example shown, the cross-section passes through the center of the hourglass shaped deformable element 2312. The center of the hourglass shaped deformable element 2312 includes a thinner portion 2313 of the hourglass shaped deformable element 2312. The wider portion 2314 of the hourglass shaped deformable element 2312 is shown in the background. The wider portion 2314 contacts the outer edges of the bottom of a beverage container. The second deformable elements 2316 also contact the outer edges of the bottom of the beverage container (not shown). First vertical elements 2318 contact the sides of the beverage container to retain the container in place. Thin deformable elements 2324 extend from the center of the cup-shaped element up the sides of the cup-shaped element. In certain cases, a thin deformable element 2326 may be disposed between the first vertical elements 2316.

Figure 24:
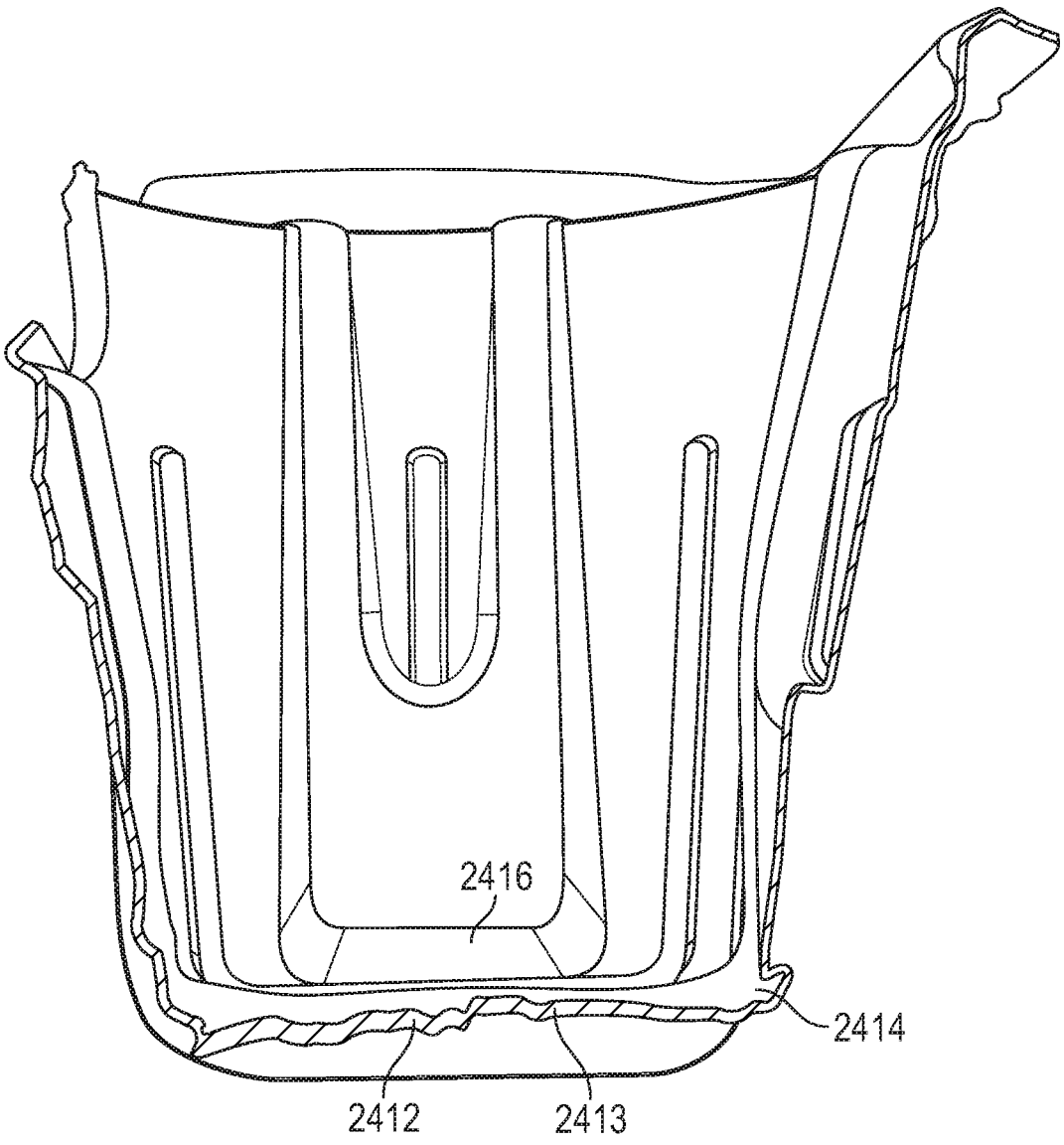
FIG. 24 depicts a second cross-section view of a cup-shaped element of a bottom tray according to various embodiments.

FIG. 24 depicts a second cross-section view of a cup-shaped element of a bottom tray according to various embodiments. FIG. 24 includes a cross-section view along section B-B as shown in FIG. 22. In the example shown, the cross-section passes through the center of the hourglass shaped deformable element 2412. The thinner portions 2413 and wider portions 2414 of the hourglass shaped element 2412 are raised up from a bottom surface of the cup-shaped element 2412. The wider portions of the hourglass shaped element 2412 contact a beverage container placed into the cup-shaped element 2412. When a load is applied to a beverage container with a convex bottom (such as a wine bottle, beer bottle, etc.), the wider portions 2414, which contact the bottom of the bottle, are configured to deform and absorb the energy of the load. The second deformable portion 2416 (shown in the background of the cross-section) is similarly configured to deform and absorb a load applied to a beverage container.

Figure 25:
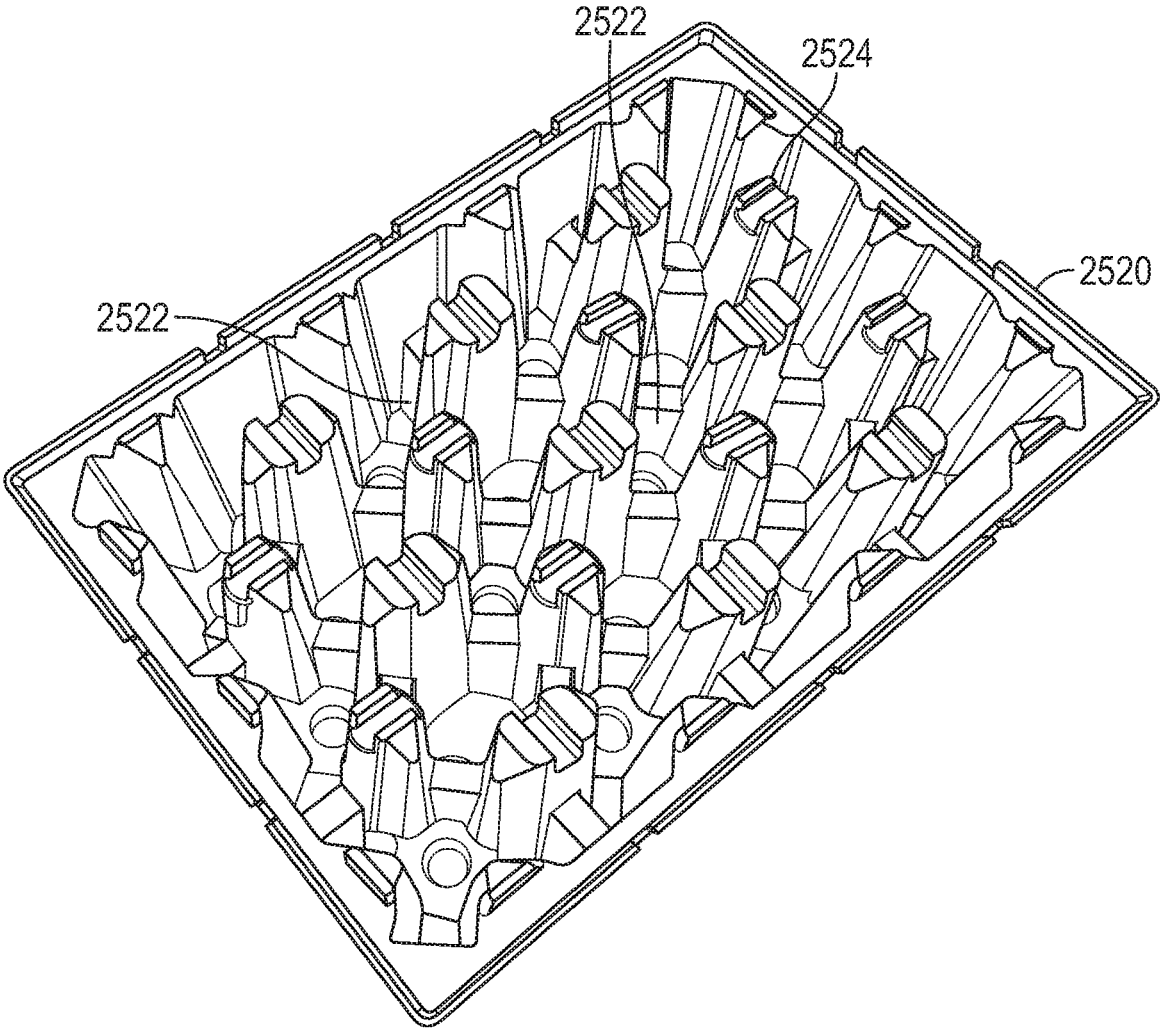
FIG. 25 depicts a top tray of a beverage container packaging assembly according to some embodiments.

FIG. 25 depicts a top tray of a beverage container packaging assembly according to some embodiments. In the example shown, a top tray 2520 includes rectangular cup-shaped elements 2522, vertical posts 2524, and/or other elements. The rectangular cup-shaped elements 2522 are configured to accommodate a neck of a beverage container, such as a wine bottle. The number of cup-shaped elements 2522 corresponds to a number of beverage containers the top tray 2520 is configured to accommodate. In the example shown, the top tray 2520 includes twelve rectangular cup-shaped elements 2522—three (3) rows of four (4) cup-shaped elements 2522—and the bottom tray is configured to accommodate twelve beverage containers. FIG. 25 depicts one example configuration of rectangular cup-shaped elements, and the present disclosure is in no way limited to the depicted configuration.

Figure 26:
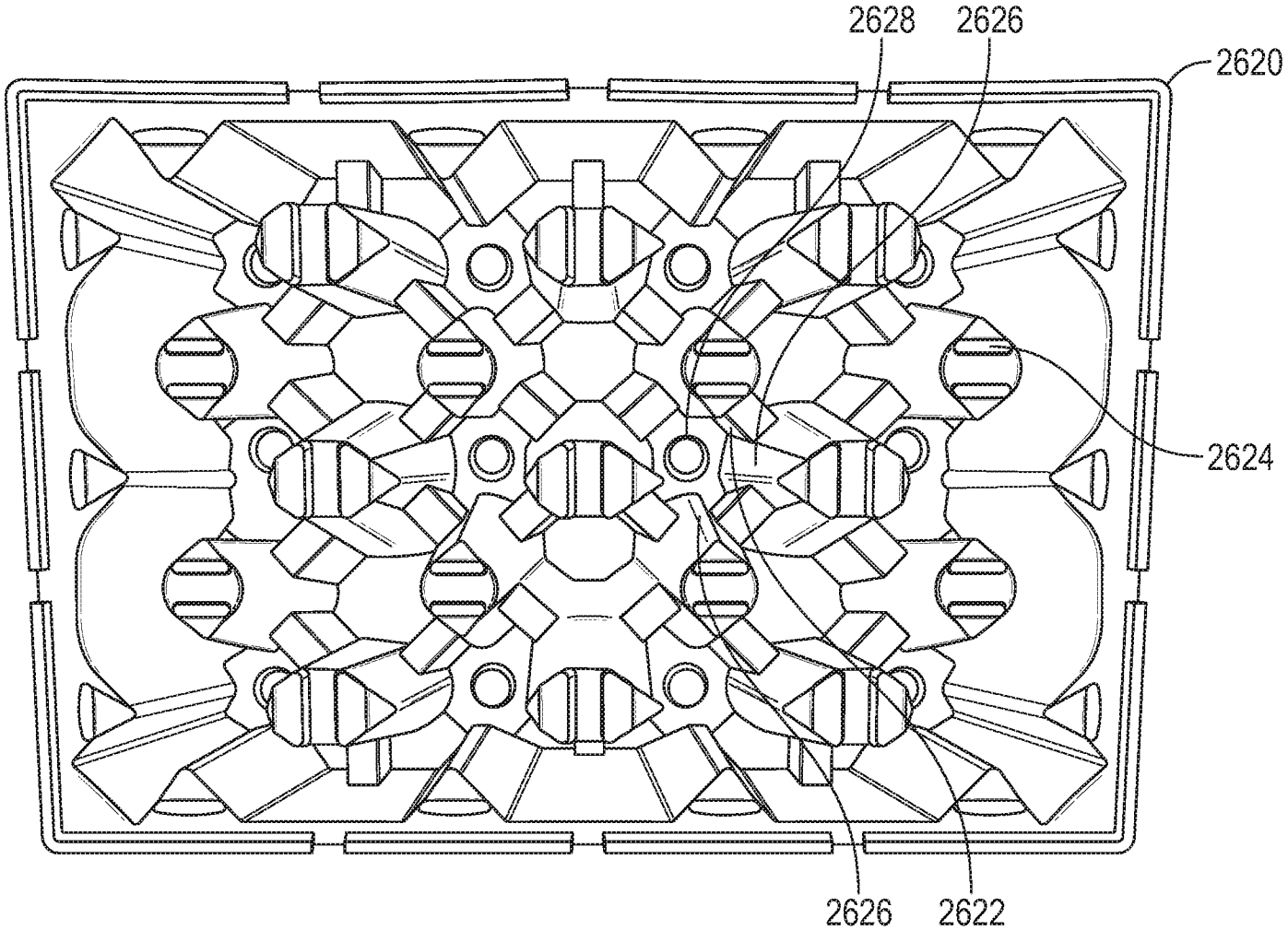
FIG. 26 depicts a top tray of a beverage container packaging assembly according to some embodiments.

FIG. 26 depicts a top tray of a beverage container packaging assembly according to some embodiments. In the example shown, a top tray 2620 includes rectangular cup-shaped elements 2622, vertical posts 2624, and/or other elements. The rectangular cup-shaped elements 2622 include four walls forming roughly the shape of a rectangular enclosure. The vertical posts 2624 include vertical deformable elements 2626 (on each of the four surrounding vertical posts 2624). A neck of bottle may, for example, be in contact with four vertical deformable elements 2626. The vertical deformable elements 2626 in contact with the neck of the bottle restrain the bottle from movement during shipment. The vertical deformable elements 2626 may also absorb loads applied to a side of the bottle.

In various embodiments, a bottom portion of the rectangular cup-shaped element 2622 includes a cylindrical depression 2628. The cylindrical depression 2628 may be sized to accommodate a top of a bottle (not shown) and to restrain the top of the bottle from movement during transit.

Figure 27:
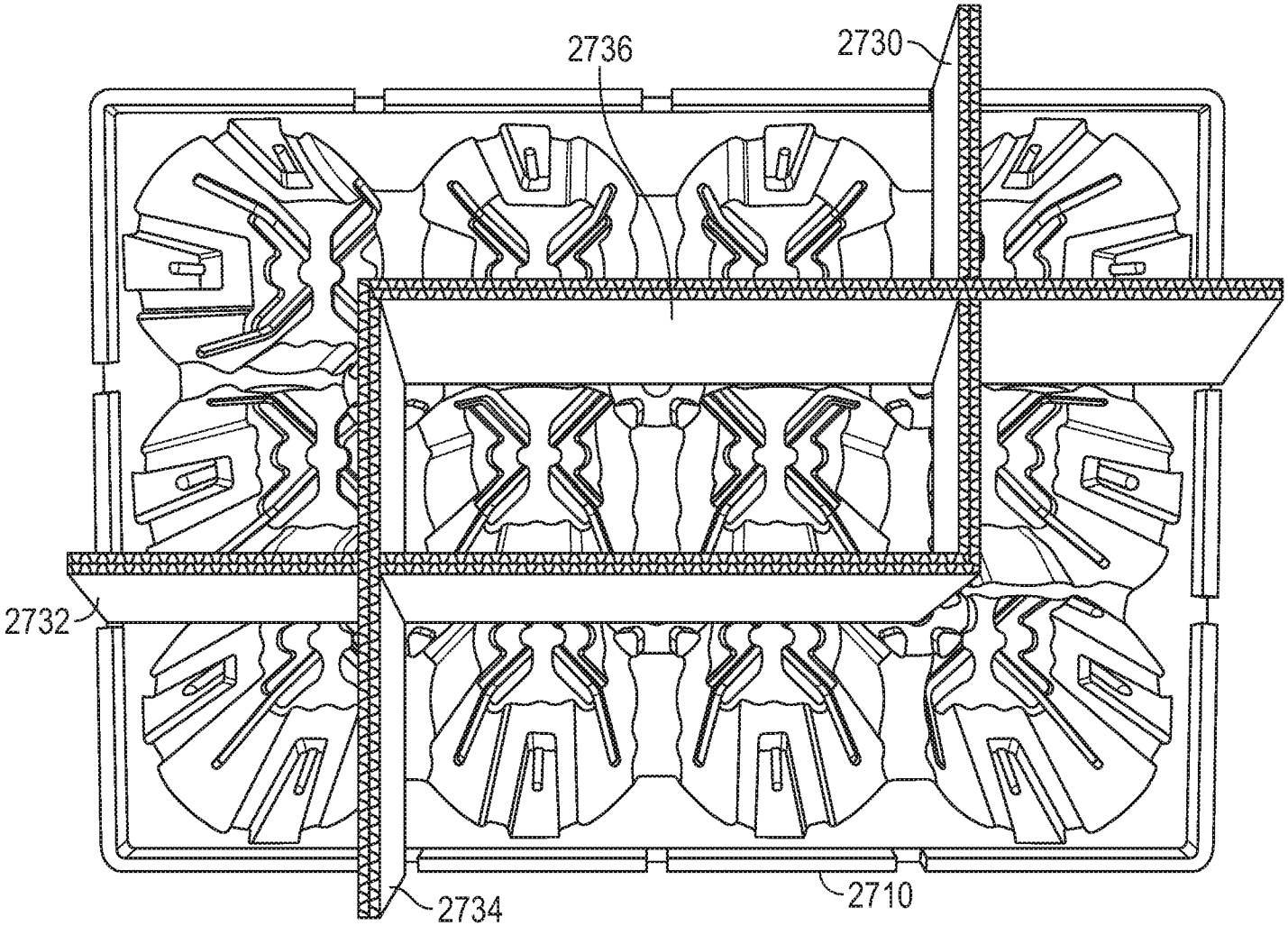
FIG. 27 depicts a bottom tray and center support of a beverage container packaging assembly according to some embodiments.

FIG. 27 depicts a bottom tray and center support of a beverage container packaging assembly according to some embodiments. In the example shown, a center support 2730 rests on a lower tray 2710 (e.g., lower tray 1810 of FIG. 18). The center support 2730 may be an alternative design relative to center support 1830, 1930 of FIGS. 18 and 19. The center support 2730 includes two cardboard elements 2732, 2734. The cardboard elements 2732, 2734 may include corrugated cardboard or any other type of cardboard. The cardboard elements 2732, 2734 may be L-shaped and/or include a bend. A first cardboard element 2732 may include cutouts (e.g., notches) that align with cutouts in the second cardboard element 2734. When installed, the first cardboard element 2732 and second cardboard element 2734 may interlock to form a rectangular section 2736. The rectangular section 2736 may span (e.g., surround, enclose) two securement chambers of the lower tray 1810.

Figure 28:
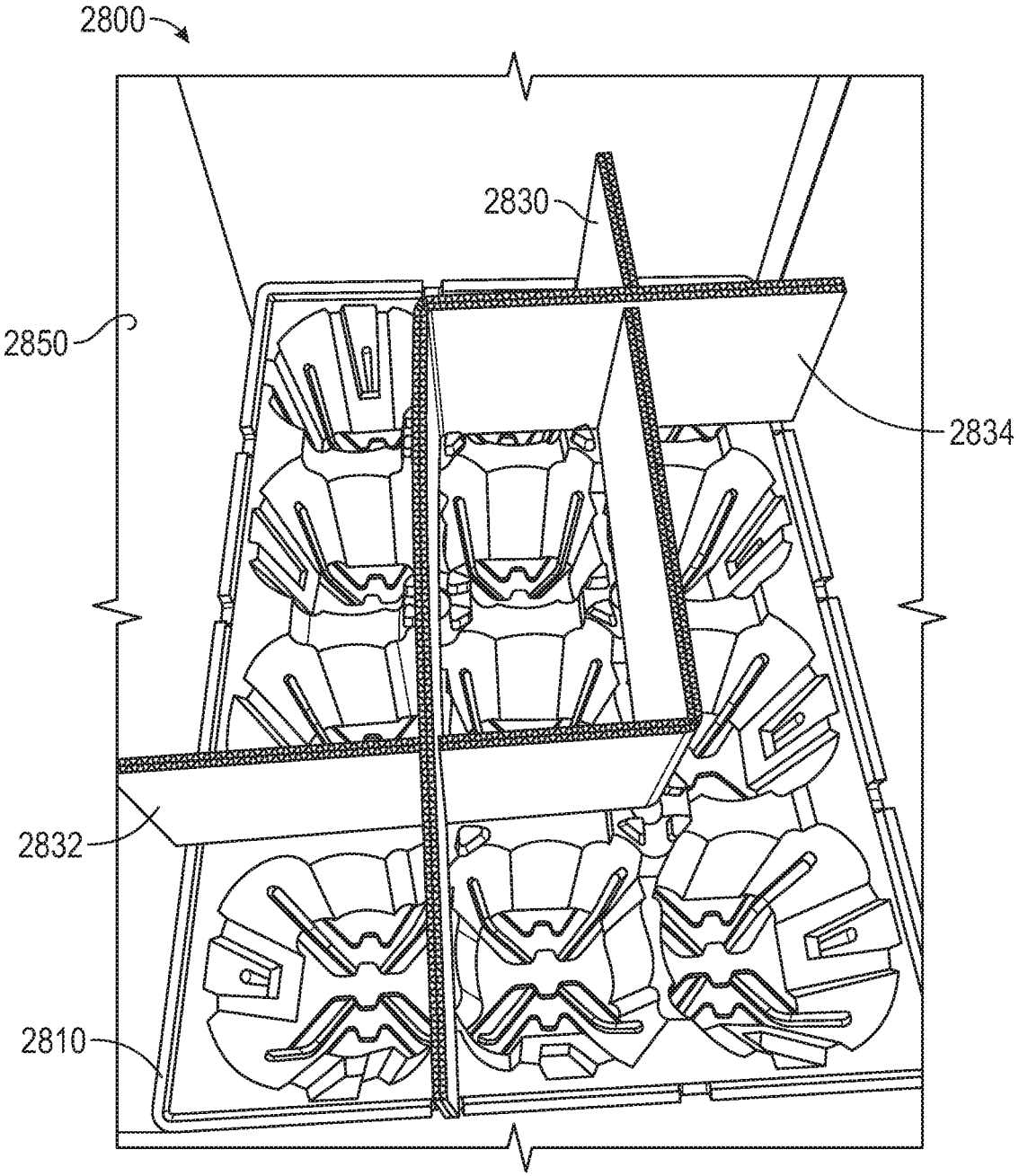
FIG. 28 depicts a beverage container packaging assembly including a lower tray and center support according to some embodiments.

FIG. 28 depicts a beverage container packaging assembly including a lower tray and center support according to some embodiments. In the example shown, a center support 2830 rests on a lower tray 2810 (e.g., lower tray 1810 of FIG. 18). The center support 2830 may be an alternative design relative to center support 1830, 1930 of FIGS. 18 and 19 and the center support 2730 of FIG. 27. The center support 2830 includes two cardboard elements 2832, 2834. Each of the cardboard elements 2832, 2834 includes two corrugated sections. In other words, the cardboard elements 2832, 2834 include double-walled corrugated cardboard including two layers of corrugation. For example, the two layers of corrugation may resemble double-layered sandwich.

In various embodiments, the center support 2830, the center support 2730 of FIG. 27, center support 1830 of FIG. 18, center support 600 of FIG. 6, center support 700 of FIG. 7, center support 1300 of FIG. 13, center support 1600 of FIG. 16, and center support 1700 of FIG. 17 include several example center support configurations contemplated by the present disclosure. In some embodiments (not shown), the center support may include triple-walled corrugated and/or any other number of stacked corrugated sections. Alternatively, the center support may include cardboard without any corrugation. For example, the center support may include a stack of multiple sheets of cardboard with no corrugation. The present disclosure, however, is not limited to these configurations and is intended to encompass a wide variety of center support designs.

In various embodiments, assembly of a beverage container packaging assembly 2800 is depicted. A lower tray 2810 may be placed into a container 2850, such as a cardboard box, crate, and/or other container. A center support (e.g., center support 600, 700, 1300, 1600, 1700, 1830, 2730, 2830, and/or any other center support) is placed onto the lower tray 2810. Beverage containers (not shown) are loaded into cup-shaped elements of the lower tray 2810. An upper tray (not shown) is placed on the top of the center support. The container 2850 is sealed by, for example, closing the flaps of the box and/or applying tape. The container 2850 may be then be shipped to its recipient. And upon receipt, a recipient may perform the inverse (opposite) of these steps to unpack the beverage container packaging assembly 2800.

In various embodiments, these and other steps to assemble and disassemble a container packaging assembly 2800 may be performed in other sequences to achieve similar results.

While various embodiments of the present invention have been described above, it should be understood that they have been presented by way of example only, and not limitation. Thus, the breadth and scope of the present invention should not be limited by any of the above-described illustrative embodiments, but should instead be defined only in accordance with the following claims and their equivalents.

What is claimed is:

1. A beverage container packaging assembly comprising:

a bottom tray of molded paper pulp including a plurality of cup-shaped elements, the cup-shaped elements including a first deformable element and a second deformable element, the first and second deformable elements including different widths, wherein at least one of the first deformable element and the second deformable element includes at least two overlapping elements;

a top tray of molded paper pulp including a plurality of bottle neck accommodating spaces each bounded by at least one deformable element, the bottle neck accommodating spaces configured to accommodate a neck portion of the beverage container; and a center support of molded paper pulp disposed between the bottom tray and the top tray, the center support including a plurality of center support posts, at least one recessed element located between at least two of the center support posts, and a plurality of beverage container support cavities bounded by one or more of the center support posts, wherein one or more walls of the beverage container support cavities are configured to surround at least a portion of the beverage container, and wherein a cross-sectional area of the center support decreases between a top end of the center support and a bottom end of the center support.

2. The beverage container packaging assembly of claim 1, wherein the at least two overlapping elements form a cross shape.

3. The beverage container packaging assembly of claim 1, wherein the first deformable element and the second deformable element include a cross shape.

4. The beverage container packaging assembly of claim 1, wherein the top tray further includes a plurality of vertical members, and the center support posts contact one of the plurality of vertical members when the beverage container packaging assembly is assembled.

5. The beverage container packaging assembly of claim 4, wherein at least one first flat surface of the center support posts contacts at least one second flat surface of the vertical members.

6. The beverage container packaging assembly of claim 1, wherein the cup-shaped elements comprise a draft.

7. The beverage container packaging assembly of claim 1, wherein the cup-shaped elements vary in diameter from a bottom end to a top end of the bottom tray.

8. The beverage container packaging assembly of claim 1, wherein the top tray further includes a plurality of vertical members including one or more deformable elements, the deformable elements at least partially surrounding the bottle neck accommodating spaces.

9. The beverage container packaging assembly of claim 8, wherein at least one of the vertical members comprises a vertical post.

10. The beverage container packaging assembly of claim 8, wherein the deformable elements extend towards a center of at least one of the bottle neck accommodating spaces.

11. The beverage container packaging assembly of claim 1, wherein the beverage container support cavities include one or more of a quarter circle shape, a half circle shape, and full circle shape.

12. The beverage container packaging assembly of claim 1, wherein at least one of the beverage container support cavities include a semi-circular shape and at least one of the beverage container support cavities include a fully circular shape.

13. The beverage container packaging assembly of claim 1, wherein the walls of the beverage container support cavities are configured to fully encapsulate the beverage container.

14. The beverage container packaging assembly of claim 1, wherein a first set of the beverage container support cavities are configured to fully encapsulate the beverage container and a second set of the beverage container support cavities are configured to partially encapsulate the beverage container.

15. The beverage container packaging assembly of claim 1, wherein the bottom tray, center support, and top tray are configured to contact the beverage container.

16. The beverage container packaging assembly of claim 1, wherein at least one of the center support posts include a thru hole.

17. The beverage container packaging assembly of claim 1, wherein the beverage container support cavities are configured to fully encapsulate a beverage container.

18. The beverage packaging assembly of claim 1, wherein the beverage support cavities further include a draft such that the beverage support cavities vary in diameter from a bottom end of the center support to a top end of the center support.

* * * * *